US007892040B2

(12) United States Patent
Ellis et al.

(10) Patent No.: US 7,892,040 B2
(45) Date of Patent: Feb. 22, 2011

(54) COMMUNICATIONS CONNECTORS WITH JACKWIRE CONTACTS AND PRINTED CIRCUIT BOARDS

(75) Inventors: Thomas Ellis, Dallas, TX (US); Michael Walter Canning, Plano, TX (US); Troy Long, Omaha, NE (US); Ron Guelden, Omaha, NE (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/539,641

(22) Filed: Aug. 12, 2009

(65) Prior Publication Data

US 2009/0298341 A1 Dec. 3, 2009

Related U.S. Application Data

(62) Division of application No. 11/379,100, filed on Apr. 18, 2006, now Pat. No. 7,591,686.

(51) Int. Cl.
*H01R 24/00* (2011.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 5,186,647 | A | 2/1993 | Denkmann et al. | 439/395 |
| 5,488,201 | A * | 1/1996 | Liu | 174/262 |
| 5,674,093 | A | 10/1997 | Vaden | 439/676 |
| 5,779,503 | A | 7/1998 | Tremblay et al. | 439/676 |
| 5,911,602 | A | 6/1999 | Vaden | 439/676 |
| 5,997,358 | A | 12/1999 | Adriaenssens et al. | 439/676 |
| 6,074,256 | A | 6/2000 | Arnett | |
| 6,079,996 | A | 6/2000 | Arnett | 439/188 |
| 6,102,722 | A | 8/2000 | Arnett | 439/189 |
| 6,116,964 | A | 9/2000 | Goodrich et al. | 439/676 |
| 6,139,371 | A | 10/2000 | Troutman et al. | 439/676 |
| 6,190,211 | B1 | 2/2001 | Chu | |

(Continued)

FOREIGN PATENT DOCUMENTS

| | | |
|---|---|---|
| EP | 0 982 815 | 3/2000 |

(Continued)

OTHER PUBLICATIONS

International Search Report and Written Opinion for PCT/US2007/008867; Oct. 5, 2007.

*Primary Examiner*—Xuong M Chung Trans
(74) *Attorney, Agent, or Firm*—Myers Bigel Sibley & Sajovec

(57) ABSTRACT

Communications connectors having a plurality of signal carrying paths include a printed circuit board and a plurality of contacts. The printed circuit board has a plurality of contact pads, a plurality of output terminals, and a plurality of conductive paths that electrically connect at least some of the plurality of contact pads to respective ones of the plurality of output terminals. The contacts each have a plug contact region. In these connectors, a first of the plurality of signal carrying paths extends from the plug contact region of a first of the plurality of contacts to a first of the plurality of output terminals through a first of the contact pads and a first of the conductive paths.

12 Claims, 20 Drawing Sheets

U.S. PATENT DOCUMENTS

| | | | | |
|---|---|---|---|---|
| 6,270,358 | B1 | 8/2001 | Nozick | 439/76.1 |
| 6,283,795 | B1 | 9/2001 | Chen | 439/676 |
| 6,305,950 | B1 | 10/2001 | Doorhy | 439/76.1 |
| 6,350,158 | B1 * | 2/2002 | Arnett et al. | 439/676 |
| 6,379,157 | B1 | 4/2002 | Curry et al. | 439/676 |
| 6,413,121 | B1 | 7/2002 | Hyland | |
| 6,443,777 | B1 * | 9/2002 | McCurdy et al. | 439/676 |
| 6,464,541 | B1 * | 10/2002 | Hashim et al. | 439/676 |
| 6,506,080 | B2 | 1/2003 | Hyland | 439/676 |
| 6,530,810 | B2 | 3/2003 | Goodrich et al. | 439/676 |
| 6,533,618 | B1 | 3/2003 | Aekins | |
| 6,547,604 | B2 | 4/2003 | Arnett et al. | 439/676 |
| 6,663,436 | B1 | 12/2003 | Arnett et al. | |
| 6,663,437 | B2 | 12/2003 | Korsunsky et al. | 439/676 |
| 6,736,681 | B2 | 5/2004 | Arnett | 439/676 |
| 6,767,257 | B2 | 7/2004 | Arnett et al. | 439/676 |
| 6,786,776 | B2 * | 9/2004 | Itano et al. | 439/676 |
| 6,816,025 | B2 * | 11/2004 | Nguyen | 333/1 |
| 6,984,155 | B1 | 1/2006 | Liu | 439/676 |
| 7,074,092 | B1 * | 7/2006 | Green et al. | 439/676 |
| 7,179,131 | B2 | 2/2007 | Caveney et al. | |
| 7,186,148 | B2 * | 3/2007 | Hashim | 439/676 |
| 7,281,957 | B2 | 10/2007 | Caveney | |
| 7,591,686 | B2 * | 9/2009 | Ellis et al. | 439/676 |
| 2005/0099243 | A1 | 5/2005 | Weng | |

FOREIGN PATENT DOCUMENTS

| | | |
|---|---|---|
| FR | 2 823 606 | 10/2002 |

* cited by examiner

COMMUNICATIONS CONNECTORS WITH JACKWIRE CONTACTS AND PRINTED CIRCUIT BOARDS

CLAIM OF PRIORITY

This application claims priority as a divisional application to U.S. patent application Ser. No. 11/379,100, filed Apr. 18, 2006 now U.S. Pat. No. 7,591,686, the disclosure of which is hereby incorporated herein in its entirety.

FIELD OF THE INVENTION

The present invention relates generally to communication connectors and, more particularly, to communications connectors that include jackwire contacts and a printed circuit board.

BACKGROUND

In an electrical communications system, it is sometimes advantageous to transmit information signals (e.g., video, audio, data) over a pair of wires (hereinafter "wire pair" or "differential pair") rather than a single wire. The signals transmitted on each wire of the wire pair have equal magnitudes, but opposite phases, and the information signal is embedded as the voltage difference between the signals carried on the two wires. This transmission technique is generally referred to as "balanced" transmission. When signals are transmitted over wires, electrical noise from external sources such as lightning, automobile spark plugs, radio stations, etc. may be picked up by the wire, degrading the quality of the signal carried by the wire. With balanced transmission techniques, each wire in a wire-pair often picks up approximately the same amount of noise from these external sources. Because approximately an equal amount of noise is added to the signals carried by both wires of the wire pair, the information signal is typically not disturbed, as the information signal is extracted by taking the difference of the signals carried on the two wires of the differential pair, and thus the noise signal is cancelled out by the subtraction process.

Many communications systems include a plurality of differential wire pairs. For example, the typical telephone line includes two differential wire pairs (i.e., a total of four wires), where one wire pair carries the voice signal that travels in one direction (i.e., the voice signal from the calling party to the called party) and the other wire pair carries the voice signal traveling in the opposite direction (i.e., from the called party to the calling party). Similarly, high speed communications systems that are used to connect computers and/or other processing devices to local area networks and/or to external networks such as the Internet typically include four differential wire pairs. In such systems, the wires of the multiple differential pairs are usually bundled together within a cable and thus necessarily extend in the same direction for some distance. Unfortunately, when multiple differential pairs are bunched closely together, another type of noise referred to as "crosstalk" may arise.

"Crosstalk" refers to signal energy from a wire of one differential pair that is picked up by a wire of another differential pair in the communications system. Typically, a variety of techniques are used to reduce crosstalk in communications systems such as, for example, tightly twisting the wires in a cable so that each wire in the cable picks up approximately equal amounts of signal energy from the two wires of each of the other differential pairs included in the cable. If this condition can be maintained, then the crosstalk noise may be significantly reduced, as the wires of each differential pair carry equal magnitude, but opposite phase signals such that the crosstalk added by the two wires of a differential pair onto the other wires in the cable tends to cancel out. While such twisting of the wires and/or various other known techniques may substantially reduce crosstalk in cables, most communications systems include both cables and communications connectors that interconnect the cables and/or connect the cables to computer hardware. Unfortunately, the communications connector configurations that were adopted years ago generally did not maintain the wires of each differential pair a uniform distance from the wires of the other differential pairs in the connector hardware. Moreover, in order to maintain backward compatibility with connector hardware that is already in place in homes and office buildings throughout the world, the connector configurations have, for the most part, not been changed. As a result, many current connector designs generally introduce some amount of crosstalk.

FIG. 1 depicts an exemplary electrical communications system in which crosstalk is likely to occur. As shown in FIG. 1, a computer 1 is connected by a cable 2 that contains a plurality (typically four) wire-pairs to a modular wall jack 5 that is mounted in a wall plate 9. The cable 2 is a patch cord that includes a modular plug 3, 3' at each end thereof. Modular plug 3 inserts into a modular jack (not pictured in FIG. 1) provided in the back of the computer 1, and modular plug 3' inserts into an opening 6 in the front side of the modular jack 5, wherein the blades of the plug 3' mate with respective contacts of the jack 5. In this manner, electrical signals may be communicated from the computer 1 to the modular jack 5. The modular jack 5 includes a connector assembly 7 at the back end thereof that receives and holds wires from a second cable 8 that are individually pressed into slots in the connector assembly 7 to make mechanical and electrical connection. The second cable 8 may connect the computer 1 to, for example, network equipment and/or the Internet.

Pursuant to certain industry standards (e.g., the TIA/EIA-568-B.2-1 standard approved Jun. 20, 2002 by the Telecommunications Industry Association), the communication system of FIG. 1 may include a total of eight wires (four differential pairs). These standards also specify that at the plug-jack mating point the eight wires are aligned in a row, with the four differential pairs specified as depicted in FIG. 2. As shown in FIG. 2, in at least the connection region where the contacts of the modular plug 3' (see FIG. 1) mate with the contacts of the modular jack 5, the wires of the differential pairs are not equidistant from the wires of the other differential pairs. By way of example, wire 2 (of pair 2) is closer to wire 3 (of pair 3) than is wire 1 (of pair 2) to wire 3. Consequently, differential capacitive and/or inductive couplings occurs between the wires of pairs 2 and 3 that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). This crosstalk is an undesirable signal that interferes with the information signal. Similar differential coupling occurs with respect to the other wire pairs in the modular plug 3' and the modular jack 5.

U.S. Pat. No. 5,997,358 to Adriaenssens et al. (hereinafter "the '358 patent") describes a two-stage scheme for compensating NEXT for a plug-jack combination. The entire contents of the '358 patent are hereby incorporated herein by reference as if set forth fully herein, as are the contents of U.S. Pat. Nos. 5,915,989; 6,042,427; 6,050,843; and 6,270,381. Connectors described in the '358 patent can reduce the internal NEXT (original crosstalk) between the electrical wire pairs of a modular plug by adding a fabricated or artificial crosstalk, usually in the jack, thereby canceling or reducing the overall crosstalk for the plug-jack combination. The fabricated crosstalk is referred to herein as a compensation crosstalk. One method of reducing NEXT disclosed in the '358 patent is by twice crossing the path of one of the differential pairs within the connector relative to the path of another differential pair within the connector, thereby providing two stages of NEXT compensation. Alternatively, the first and/or second compensation stages can be implemented using discrete components and/or by inducing desired capacitive and/or inductive coupling without actually crossing wire paths. The multi-stage (i.e., two or more) compensation schemes disclosed in the '358 patent can be more efficient at reducing the NEXT than schemes in which the compensation is added at a single stage, especially when the second and subsequent stages of compensation include a time delay that is selected and/or controlled to account for differences in phase between the offending and compensating crosstalk signals. This type of arrangement can include capacitive and/or inductive elements that introduce multi-stage crosstalk compensation, and is typically employed in jack lead frames and printed circuit board structures within jacks. These configurations can allow connectors to meet "Category 6" performance standards set forth in TIA/EIA 568B.2-1 standard, which are primary component standards for mated plugs and jacks for transmission frequencies up to 250 MHz.

SUMMARY

Pursuant to embodiments of the present invention, communications connectors having a plurality of signal carrying paths are provided. These communications connectors include a printed circuit board. The printed circuit board has a plurality of contact pads, a plurality of output terminals, and a plurality of conductive paths that connect at least some of the plurality of contact pads to respective ones of the plurality of output terminals. The connectors also include a plurality of contacts, each of which has a plug contact region. In these connectors, a first of the plurality of signal carrying paths extends from the plug contact region of a first of the plurality of contacts to a first of the plurality of output terminals through a first of the contact pads and a first of the conductive paths.

In some embodiments, each of the plurality of contact pads may extend from an edge of the printed circuit board onto a top surface of the printed circuit board. At least some of the contact pads may be raised contact pads that extend above a top surface of the printed circuit board, such as, for example, a nail that is inserted into the printed circuit board. The contacts of the connector may include a contact termination that is mounted in an opening in a first surface of the printed circuit board, and each of the contacts may wrap around the printed circuit board to extend above a second surface of the printed circuit board that is opposite the first surface.

In certain embodiments, each of the contact pads may be on the top surface of the printed circuit board, and each of the contacts may include an undulation region that is configured to mate with a respective one of the contact pads. The contacts include a pad contact region that is arranged to mate with a respective one of the contact pads. In some embodiments, the pad contact region is in between a mounted end of the contact and the plug contact region. In other embodiments, the pad contact region is in between the plug contact region and a free end of the contact. The pad contact region may also be within the plug contact region.

In certain specific embodiments, first through eighth contacts are provided, where the fourth and fifth contacts comprise a first contact pair for carrying a first balanced signal, the first and second contacts comprise a second contact pair for carrying a second balanced signal, the third and sixth contacts comprise a third contact pair for carrying a third balanced signal, the seventh and eighth contacts comprise a fourth contact pair for carrying a fourth balanced signal. In these embodiments, at least one of first, second third and/or fourth contact pairs includes a crossover. For example, the third contact pair may include a crossover. Alternatively, the first, second and fourth contact pairs may each include a crossover. Other crossover arrangements are also possible.

In some embodiments, the contacts include a contact termination that is mounted in respective ones of a plurality of metal-plated holes in the printed circuit board. In these embodiments, the printed circuit board may include a compensation circuit that is electrically connected by respective conductive traces to at least two of the plurality of metal-plated holes. The communications connector may also include a housing. In some embodiments, the contact termination is fixedly mounted in the housing.

Pursuant to further embodiments of the present invention, communications connectors are provided that include a printed circuit board and a plurality of contacts. The printed circuit board includes a plurality of signal carrying paths that connect a plurality of input terminals of the connector to respective of a plurality of output terminals. Each of the contacts have a mounted end at which the contact is mounted within the connector, and a plug contact region that comprises one of the plurality of input terminals. In these connectors, at least some of the mounted ends of the contacts comprise branches off of the signal carrying paths.

The printed circuit board may include a plurality of contact pads, and each of the contacts may include a pad contact region that is configured to mate with a respective one of the contact pads. The pad contact region of each contact may be, for example, (1) between the mounted end of the contact and the plug contact region of the contact or (2) between the plug contact region of the contact and a free end of the contact.

Each contact may be mounted on a first surface of the printed circuit board and wrap around to extend above a second, opposing surface of the printed circuit board. The contacts may be free-floating where they wrap around the edge of the printed circuit board. Alternatively, the mounted end of each contact may be fixedly mounted in a housing of the connector. The contacts may be disposed in a parallel side-by-side relationship over at least half of the contacts length. Moreover, the free ends of at least two adjacent ones of the contacts may be staggered with respect to each other to increase the distance between their free ends.

According to still further embodiments of the present invention, modular jacks are provided that include a printed circuit board, a plurality of raised contact pads on a first surface of the printed circuit board, and a plurality of contacts that are aligned with respective ones of the raised contact pads. In these jacks, each of the contacts is configured to make electrical contact with a respective one of the plurality of raised contact pads at a point above the first surface of the printed circuit board when the modular plug is inserted in the modular jack.

In certain embodiments of these jacks, the raised contact pads may comprise nails that are mounted in respective metal-plated holes on the printed circuit board. The upper surface of each nail may, in certain embodiments, have a dome-shape. Each nail may include a surface that includes gold that directly mates with a respective one of the first plurality of contacts. The head portion of the raised contact pad may, in certain embodiments, be at least three times thicker than the thickness of a plurality a signal carrying traces that are provided on the printed circuit board. In still other embodiments, the raised contact pads may comprise small springs that are mounted in respective metal plated holes on the printed circuit board.

Pursuant to still further embodiments of the present invention, communications connectors are provided that include a plurality of contacts. Each contact has a contact termination that is mounted in a mounting surface. The contacts further include a printed circuit board that comprises a structure separate from (but perhaps connected to) the structure that includes the mounting surface. The printed circuit board further includes a plurality of contact pads that mate with respective ones of the contacts, a plurality of output terminals, and a plurality of conductive paths that electrically connect at least some of the contact pads to respective ones of the output terminals.

In some embodiments, the mounting surface may comprise a surface on a dielectric housing of the communications connector. I other embodiments, the mounting surface may be a second printed circuit board.

Pursuant to yet further embodiments of the present invention, modular jacks are provided that include a printed circuit board that includes a plurality of contact pads, a plurality of output terminals, and a plurality of conductive paths that electrically connect at least some of the contact pads to respective ones of the output terminals. The jacks further include a plurality of contacts, each contact having a mounted end, a free end and a middle portion extending between the mounted end and the free end. In these jacks, each of the contact pads are mounted to make electrical contact with the middle portion of respective ones of the contacts when a plug is in place in the modular jack.

DETAILED DESCRIPTION

Figure 1:
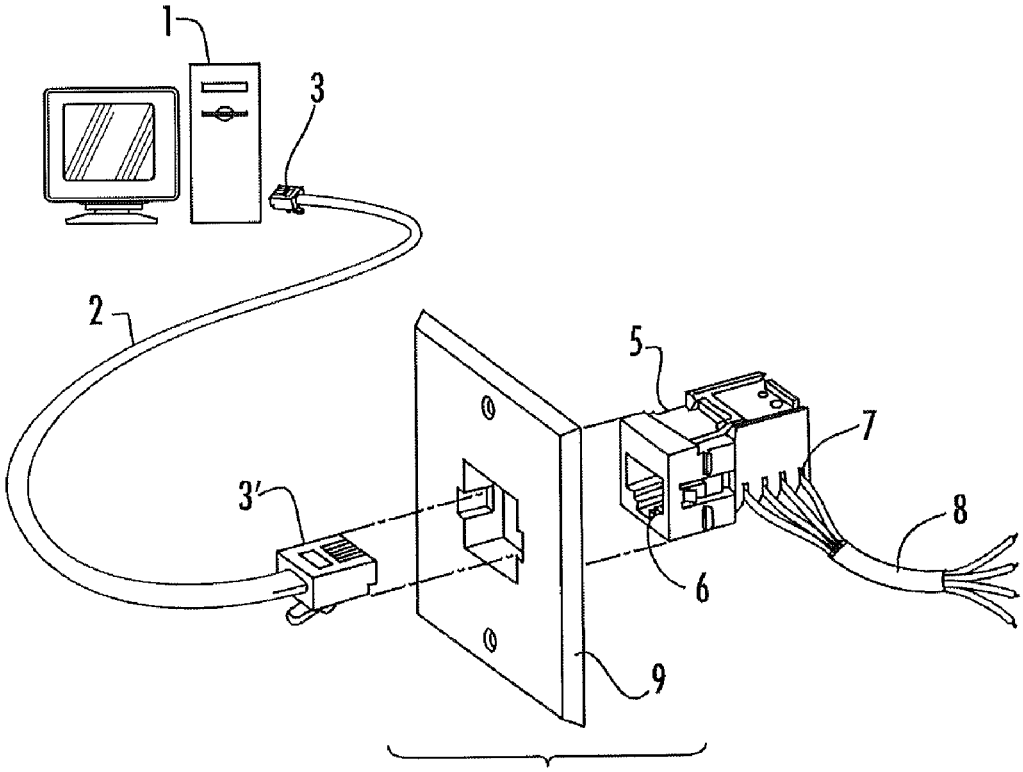
FIG. 1 (PRIOR ART)
FIG. 1 illustrates the use of modular plug and modular jack connectors to interconnect a computer with a communications cable.
Figure 2:
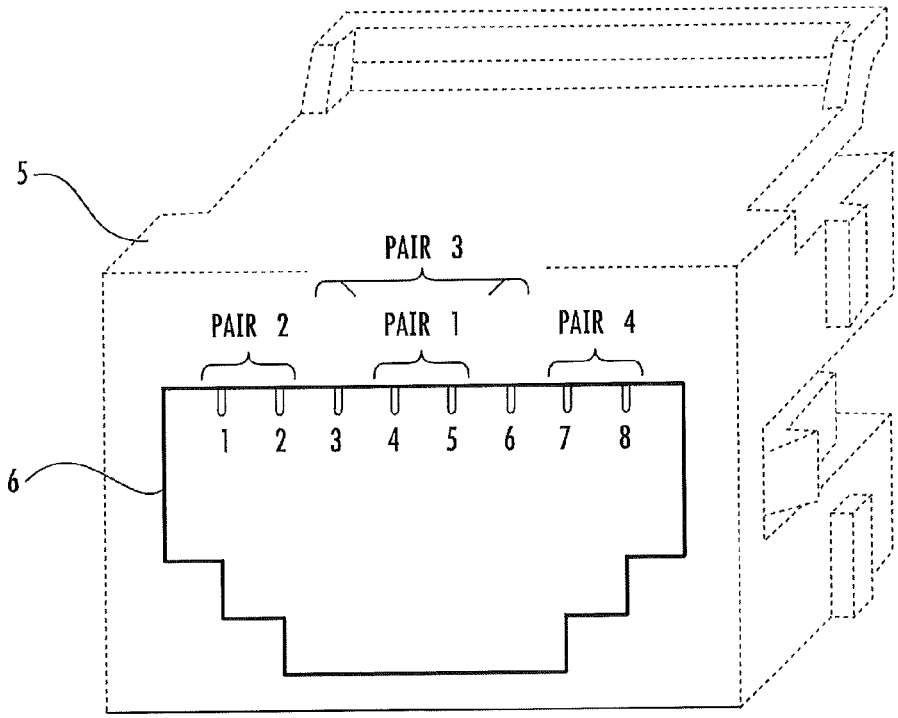
FIG. 2 shows the modular jack contact wiring assignments for an 8-position telecommunications outlet (T568B) as viewed from the front opening of a jack.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

This invention is directed to communications connectors, with a primary example of such being a communications jack. As used herein, the terms "forward", "forwardly", and "front" and derivatives thereof refer to the direction defined by a vector extending from the center of the jack toward the plug opening of the jack. Conversely, the terms "rearward", "rearwardly", and derivatives thereof refer to the direction directly opposite the forward direction; the rearward direction is defined by a vector that extends away from the plug opening toward the remainder of the jack. Where used, the terms "attached", "connected", "interconnected", "contacting", "mounted" and the like can mean either direct or indirect attachment or contact between elements, unless stated otherwise.

Figure 3:
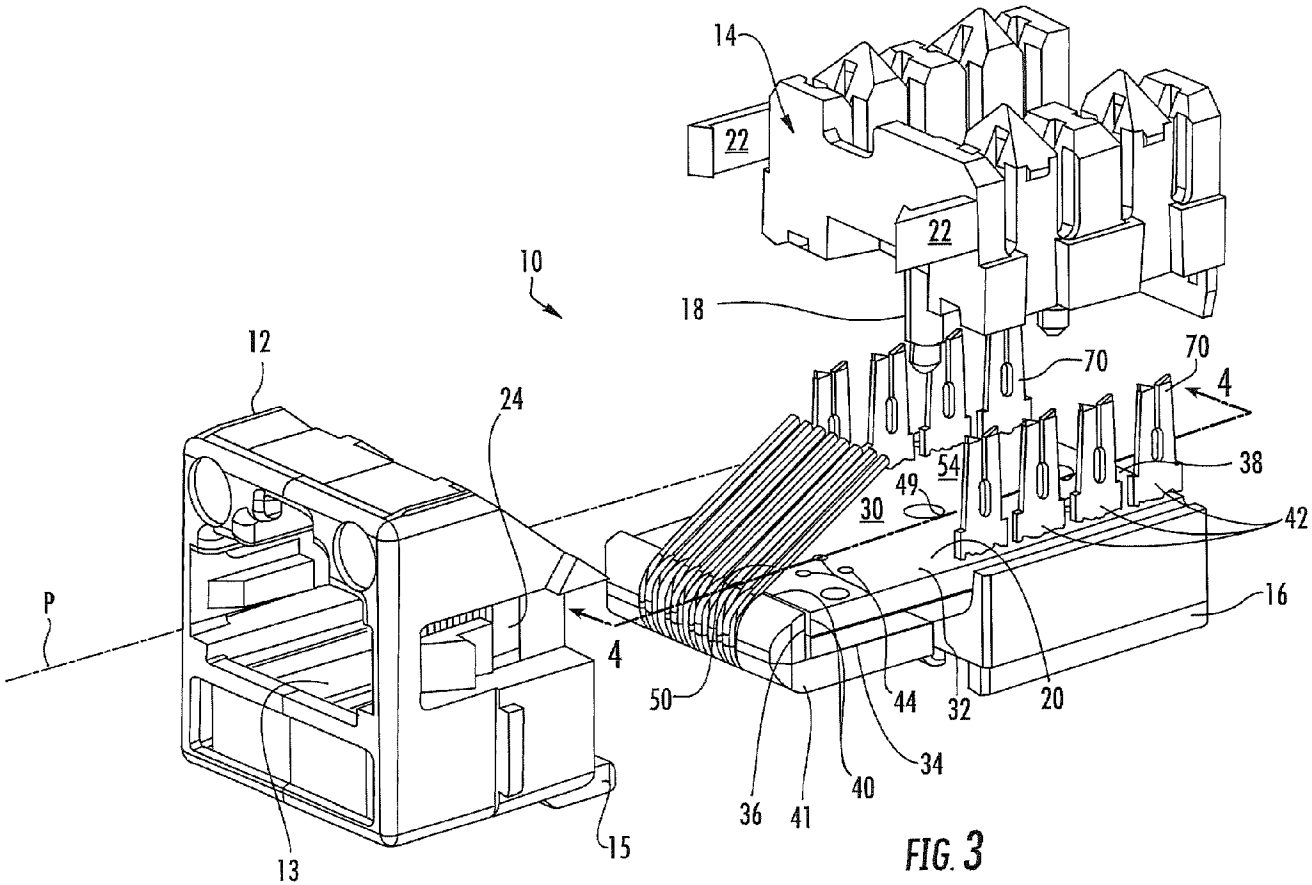
FIG. 3 is an exploded perspective view of a communications connector according to embodiments of the present invention.
Figure 4:
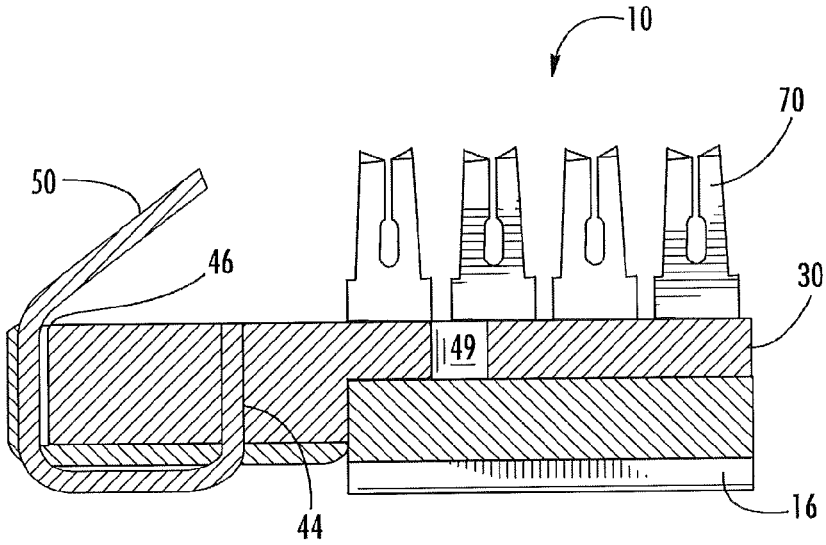
FIG. 4 is a side view of the communications connector of FIG. 3 taken along the line 4-4 of FIG. 3.
Figure 5:
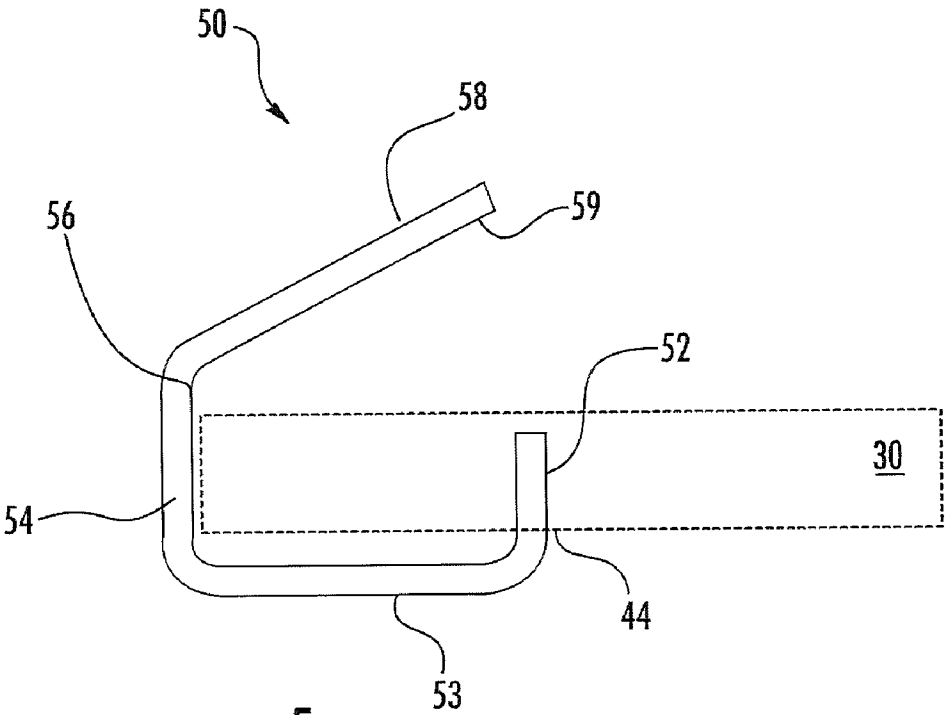
FIG. 5 is a side view of one of the jackwire contacts of the communications connector of FIG. 3.
Figure 6:
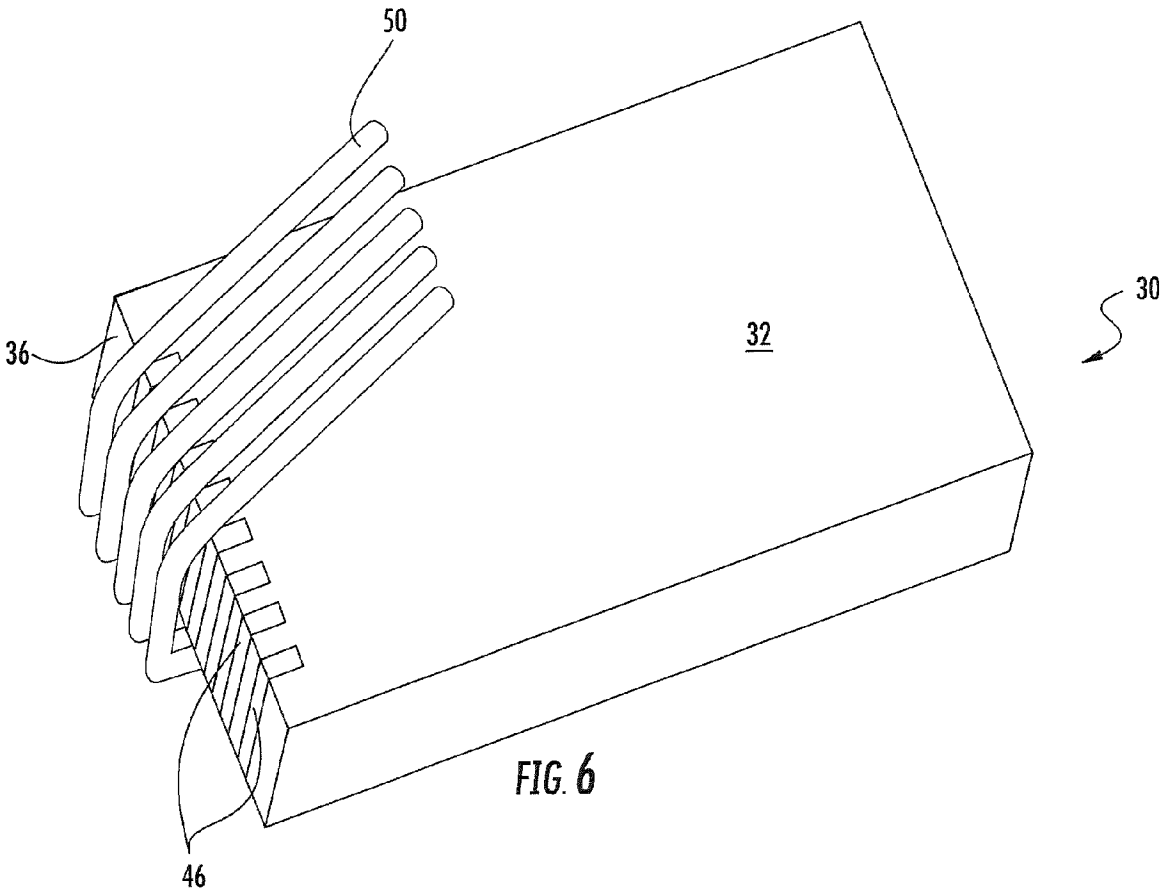
FIG. 6 is a perspective view of the printed circuit board and jackwire contacts of the communications connector of FIG. 3 with four of the jackwire contacts removed to more clearly illustrate the configuration of the contact pads provided on the printed circuit board.
Figure 7:
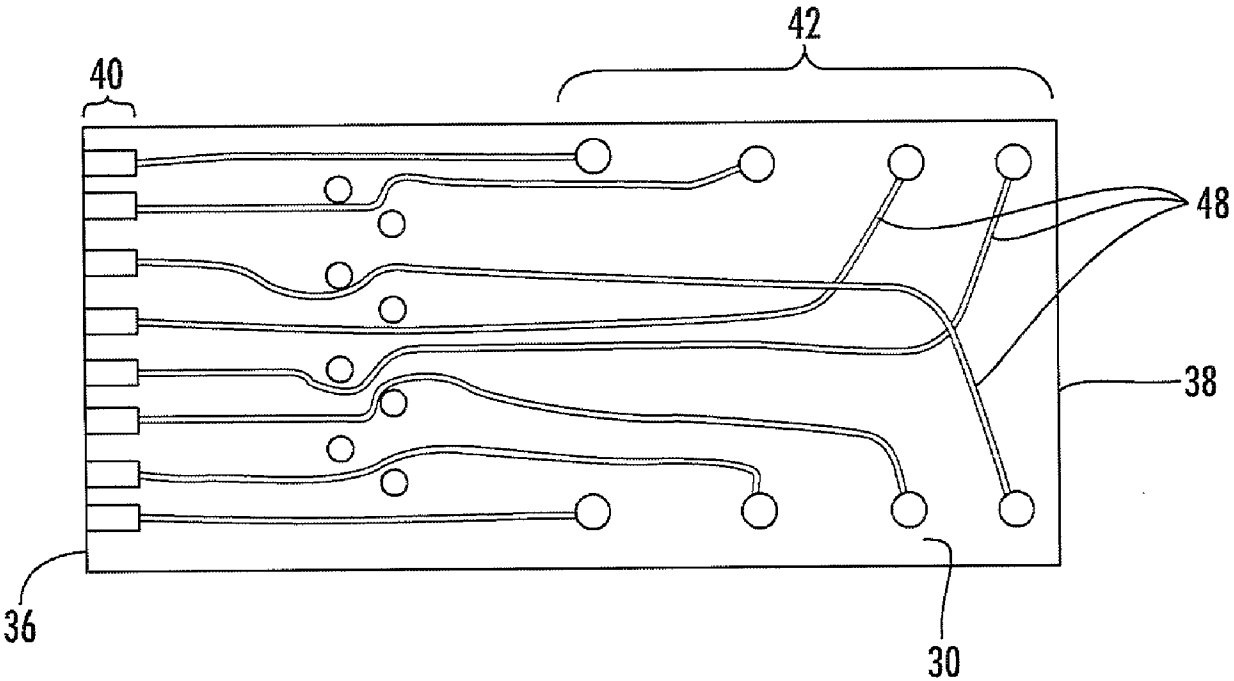
FIG. 7 is a plan view of the printed circuit board of FIG. 3 with exemplary circuit traces shown thereon.

FIG. 3 is an exploded perspective view of a communications connector 10 according to embodiments of the present invention. FIG. 4 is a side view of the communications connector 10 taken along the line 4-4 of FIG. 3. FIG. 5 is a side view of one of the jackwire contacts 50 of the electrical connector 10 that illustrates various portions of a representative jackwire contact 50. FIG. 6 is a perspective view of the printed circuit board 30 and jackwire contacts 50 of the communications connector 10 with four of the jackwire contacts removed. FIG. 7 is a plan view of the printed circuit board 30. In FIG. 7, the conductive traces are shown as existing on the top layer/surface of printed circuit board 30 for ease of description, but it will be appreciated that all or parts of one or more of the traces would be implemented on additional layers of the printed circuit board 130. The communications connector 10 of FIGS. 3-7 comprises a modular jack that is configured to mate with a modular plug (not shown in FIGS. 3-7).

As shown in FIG. 3, the communications connector 10 comprises an assembly 20, which is enclosed within an electrically insulative or dielectric jack housing 12, terminal housing 14 and cover 16. The jack housing 12 receives a front part of the assembly 20 which is inserted into an opening in the rear of the jack housing 12. The jack housing 12 further includes an opening 13 that is sized and configured to receive a modular plug (not shown in FIG. 3) that is inserted into the jack housing 12 along the axis P. Terminal housing 14 is fitted over and protects an upper surface of the assembly 20. Cover 16 fits beneath the assembly 20 and attaches to the terminal housing 14 to protect a lower surface of the assembly 20.

The assembly 20 includes a printed circuit board 30. The printed circuit board 30 may comprise, for example, a single or multi-layered dielectric substrate that includes a top surface 32, a bottom surface 34, a forward edge 36 and a rear edge 38. The printed circuit board 30 further includes a plurality of conductive traces or paths 48 (see FIG. 7) that extend between input terminals 40 of the printed circuit board 30 and output terminals 42. In the particular embodiment pictured in FIGS. 3-7, the input terminals 40 of the printed circuit board 30 are located at or adjacent to the forward edge 36 of the printed circuit board 30, and the output terminals 42 are located in two rows that extend from approximately the middle of the printed circuit board 30 to the rear edge 38 of the board 30. It will be understood that the printed circuit board 30 may comprise any conventional printed circuit or wiring board, a flexible printed circuit board, or any other type of substrate that includes conductive paths that connect input terminals to respective output terminals. As discussed in more detail herein, the printed circuit board 30 may also include electrical circuit components or devices arranged on or within the board to compensate for crosstalk that may otherwise be present in the connector. Such devices include, but are not limited to, closely spaced wire traces printed on or within layers of the printed circuit board 30, plate capacitors implemented on two or more layers or surfaces of the board, interdigitated finger capacitors such as the capacitors disclosed, for example, in U.S. Pat. No. 5,997,358, and discrete electrical components such as inductors, capacitors or resistors that are mounted on or within the printed circuit board 30. While specific layouts for such compensation circuits are not set forth in detail herein, the aforementioned '358 patent, for example, describes methods for designing such compensation circuits.

Turning again to FIG. 3, in addition to the printed circuit board 30, the assembly 20 further includes a number (in this particular embodiment, eight) of spring jackwire contacts 50 that wrap around the forward edge 36 of the printed circuit board 30. Herein, the term "contact", when used as a noun, refers to an electrically conductive element that is designed to establish physical and electrical contact with an external electrically conductive element. The jackwire contacts 50 depicted in FIG. 3 are one such type of contact that is known in the art. The jackwire contacts 50 extend above the printed circuit board 30 at an acute angle relative to the top surface 32 of the printed circuit board 30. The assembly 20 also includes a plurality of wire connection terminals 70 that are mounted in the output terminals 42 of the printed circuit board (in the embodiment of FIG. 3, the output terminals comprise the metal-plated holes 44 that receive the wire connection terminals 70). In the embodiment of FIG. 3, the wire connection terminals 70 are implemented as insulation displacement terminals (IDCs). The IDCs 70 may also include a base having a "needle-eye" construction that allows the base to be pushed into the metal-plated holes 44. The metal-plated holes 44 may have a diameter that is slightly less than the diameter of the needle-eye, which may facilitate providing a reliable electrical connection between each IDC 70 and its respective metal-plated hole 44 without a need for soldering. The IDCs or other wire connection terminals 70 may alternatively be soldered in place or press-fit in place by other means. It will also be appreciated that the wire connection terminals 70 may be replaced with other forms of output terminals such as, for example, jackwire contacts.

The terminal housing 14 mounts over the wire connection terminals 70 to further hold the IDC terminals 70 in place and/or to protect the IDC terminals 70 and the top surface 32 of the printed circuit board 30. The terminal housing 14 also permits wire lead access to the IDC terminals 70. The terminal housing 14 includes a pair of mounting posts 18 that project from a bottom surface of the terminal housing 14. When the terminal housing 14 is aligned with the IDC terminals 70 on the printed circuit board 30 and lowered to surround the IDC terminals 70, the mounting posts 18 align with a pair of mounting holes 49 provided in the printed circuit board 30 and pass through them to project from the bottom surface 34 of the printed circuit board 30.

The cover 16 may protect the bottom surface 34 of at least part of the printed circuit board 30. The cover 16 includes a pair of openings (not shown in FIG. 3) that are formed along a center line between sides of the cover 16 that align with tips of the terminal housing mounting posts 18. The printed circuit board 30 is "sandwiched" or captured between the terminal housing 14 and the cover 16, and the tips of the mounting posts 18 may be joined to the body of the cover 16 by, for example, an ultrasonic welding probe inserted into the cover openings from below the cover 16. The tips of the mounting posts 18 and the surrounding body of the cover 16 melt and fuse with one another to form solid joints when cooled. With the printed circuit board 30 thus captured between the terminal housing 14 and the cover 16, most or all of the rear portion of the printed circuit board 30 may be protectively enclosed.

As also shown in FIG. 3, the jack housing 12 has a latch 15 protruding below its rear opening. The bottom forward edge of the cover 16 includes a raised protrusion that mates with the latch 15. The terminal housing 14 likewise has a pair of side catches 22 protruding from the forward part of both sides of the housing. The side catches 22 may comprise, for example, snap clips that have hooked projecting ends that are configured to snap into and lock within respective recesses 24 provided in the side walls of the jack housing 12. Once the terminal housing 14 is joined to the cover 16 with the circuit board 30 captured between them, the forward edge 36 of the printed circuit board 30 is inserted into the rear opening in the jack frame 12 until the side catches 22 snap into place in their respective recesses 24 in the jack housing and until the latch 15 snaps over and onto the raised protrusion on the bottom of cover 16 to securely join the jack housing 12 to the remainder of the connector 10.

The jack housing 12, the terminal housing 14 and the cover 16 may be formed, for example, of a plastics material that meets applicable standards with respect to electrical insulation and flammability, such as Polyvinyl Chloride (PVC), Acrylonitrile Butadiene Styrene (ABS), or polycarbonate. It will be appreciated that many other electrically insulative or dielectric materials may be used.

While the jack housing 12, the terminal housing 14 and the cover 16 provide one example of a housing structure that may enclose the assembly 20, it will be appreciated that a wide variety of different housing structures could be used, and/or that the assembly 20 could be constructed as part of the housing itself as opposed to a separate piece. Thus, embodiments of the present invention need not be limited to any particular housing structure, and the above-provided detailed description of one particular housing arrangement is provided so that the present disclosure will be thorough and complete.

As shown best in FIGS. 4-5, each jackwire contact 50 may include a mounted end 52 (also referred to herein as a "contact termination"), a lower section 53, a vertical section 54, a pad contact region 56, a plug contact region 58 and a free end 59. The jackwire contacts 50 may be formed, for example, of a copper alloy such as spring-tempered phosphor bronze, beryllium copper, or the like. A typical cross-section of each jackwire contact 50 is 0.015 inch wide by 0.010 inch thick, although other sized contacts may be used.

The mounted end 52 of each jackwire contact 50 is mounted in respective ones of a plurality of metal-plated openings 44 that are provided on the bottom surface 34 of the printed circuit board 30 (note that the metal-plated openings 44 may extend all the way up to the top surface 32 of the printed circuit board 30). The "mounted end" 52 of a contact refers to an end portion of the contact that is securely mounted (i.e. held in a fixed position) in some structure such as, for example, a printed circuit board or a portion of the jack housing. The mounted ends 52 of the jackwire contacts 50 may have a "needle eye" construction that allows the ends to be pushed into the metal-plated holes 44. The metal-plated holes 44 may have a diameter that is slightly less than the diameter of the mounted ends 52 of the jackwire contacts 50, which may facilitate providing a reliable electrical connection between each jackwire contact 50 and its respective metal-plated hole 44 without a need for soldering.

The lower section 53 of each jackwire contact 50 runs generally parallel to and beneath the bottom surface 34 of the printed circuit board 30. The vertical section 54 of each contact runs adjacent to the forward edge 36 of the printed circuit board 30. As shown best in FIG. 4, in the embodiment of FIGS. 3-7, the vertical sections 54 of the jackwire contacts 50 may be "free-floating" in that they do not contact the forward edge 36 of the printed wiring board 30 when a plug is not inserted in the jack housing 12. This allows the jackwire contacts to deflect from the curved portion between the lower section 53 and the vertical section 54.

The plug contact region 58 refers to the portion of a jackwire contact 50 that makes mechanical and/or electrical contact with the contacts and/or housing of a modular plug that is inserted into the communications connector 10. The pad contact region 56, as discussed below, is the portion of a jackwire contact 50 that makes physical and electrical contact with a corresponding contact pad 46 (see FIG. 6) that is provided on the printed wire board 30. In certain embodiments of the present invention, the pad contact region 56 and the plug contact region 58 may be overlapping or co-located.

As shown in FIG. 3, the jackwire contacts 50 are arranged in a parallel side-by-side relationship throughout substantially their entire length. In particular, the eight contacts 50 are arranged in a row, and each jackwire contact 50 maintains a substantially constant distance from its one or two neighboring jackwire contacts 50 over substantially the entire length of the contacts. The jackwire contacts 50 according to certain embodiments of the present invention may be relatively simple to manufacture and install within the connector.

In operation, a modular plug (not shown in FIGS. 3-7) is inserted along the axis P into the opening 13 included in the front face of jack housing 12. When the modular plug is inserted into the opening 13, blades or other contacts of the plug contact respective ones of the jackwire contacts 50. The jackwire contacts 50 may comprise spring jackwires that are resiliently deflected by the plug blades toward the top surface 32 of the printed circuit board 30. The spring force of the deflected jackwires 50 holds the jackwire contacts 50 in firm contact against respective ones of the plug blades, thereby establishing an electrical connection between each of the plug blades and a respective one of the jackwire contacts 50.

Pursuant to embodiments of the present invention, the input terminals 40 may comprise a plurality of contact pads 46 that are provided on the printed circuit board 30. Each of the contact pads 46 is arranged so as to mate with the pad contact region 56 of a respective one of the jackwire contacts 50 when a modular plug is inserted into the modular jack, thereby deflecting the jackwire contacts 50. The contact pads 46 may be implemented as any conductive pad or other structure that makes reliable electrical contact with its respective jackwire contact under appropriate conditions (e.g., when a plug is inserted into the jack). As discussed herein, structures having a significant three-dimensional aspect such as nails, blocks columns or the like may be used as contact pads 46 in certain embodiments of the present invention.

FIG. 6 more clearly illustrates one implementation of the contact pads 46 according to embodiments of the present invention. In FIG. 6, four of the jackwire contacts 50 have been removed to more clearly show the contact pads 46. As shown in FIG. 6, a plurality of contact pads 46 are provided along the forward edge 36 of the printed circuit board 30. The contact pads 46 may also extend onto the top surface 32 of the printed circuit board 30. In the embodiment of FIGS. 3-7, a total of eight contact pads 46 are provided. Each contact pad 46 is positioned to mate with a respective one of the jackwire contacts 50 when, as discussed above, a modular plug is inserted into the opening 13 in the jack housing 12. When the jackwire contacts 50 mate with respective ones of the contact pads 46, an electrical connection is established such that an electrical signal may pass from the blade of the modular plug, to the jackwire contact 50 with which the plug blade mates, and then through the contact pad 46 that mates with the jackwire contact 50 at issue. The contact pads 46 may be formed of a variety of conductive materials such as, for example, copper or copper alloys (with or without plating). In certain embodiments of the present invention, the contact pads may comprise a gold or nickel plated copper alloy.

Figure 8:
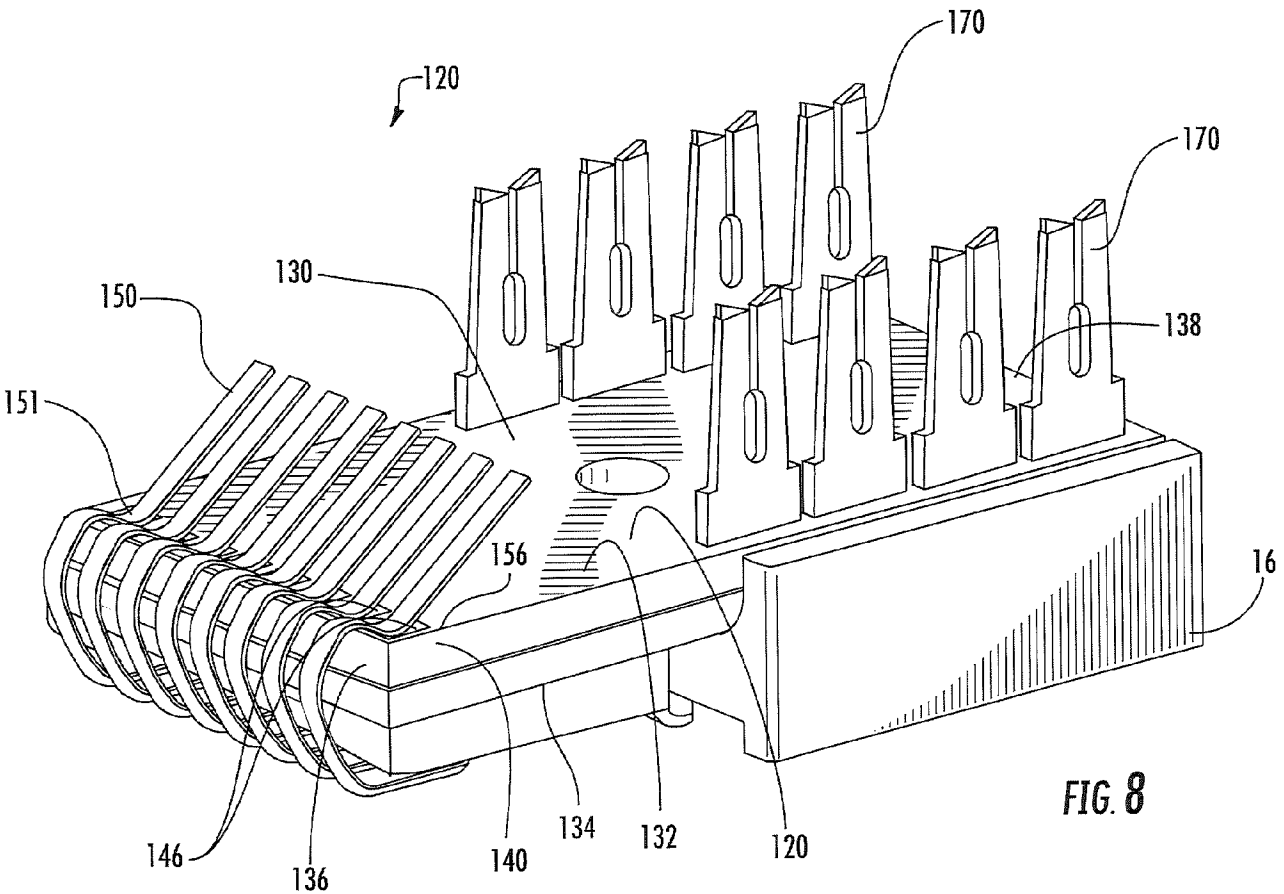
FIG. 8 is an exploded perspective view of a communications connector according to further embodiments of the present invention.

In the embodiment of FIGS. 3-7, the contact pads 46 are deposited on the forward edge 36 and a small portion of the top surface 32 of the printed circuit board 30. It will be appreciated that the contact pads 46 need not, for example, extend vertically along the entire forward edge 36 of the printed circuit board 30, as, in the embodiment of FIGS. 3-7, the electrical connection between each jackwire contact 50 and its respective contact pad 46 may primarily occur at the forward edge of the upper surface 32 of the printed circuit board 30. It will also be appreciated that the contact pads 46 may be located at a wide variety of different places on the printed circuit board 30. By way of example, FIG. 8 depicts another embodiment of the present invention in which the contact pads 46 are located exclusively on the top surface 32 of the printed circuit board 30. In the embodiment of FIGS. 3-7, the vertical portion of each contact pad 46 is simply plated on the forward edge 36 of the printed circuit board 30. An optional mandrel 41 may be provided to facilitate keeping the contacts 50 in proper alignment. In other embodiments, eight grooves may be cut into the forward edge 36 of the printed circuit board 30, and the conductive plating that forms the vertical portion of each contact pad 46 is plated on the side and back walls of each groove. The grooves may be relatively shallow, but in still other embodiments, the grooves may be deeper such that the sidewalls of the grooves form a comb structure that can be used to maintain the individual jackwires in proper alignment for mating with the modular plug and their respective contact pads 46, which may eliminate any need for a mandrel 41. Moreover, in the embodiments that include grooves, the back wall of each groove may be slanted such that the upper portion of the groove is wider than the lower portion of the groove. This slanting may be used to increase the surface area over which the pad contact region 56 of each jackwire contact 50 makes physical contact with its corresponding contact pad 46 when a plug is inserted into the connector 10.

As best shown in FIGS. 4-5, in the communications connector 10 of FIGS. 3-6, the jackwire contacts 50 are not in contact with their respective contact pads 46 except when a modular plug is inserted into the communications connector 10. When a plug is inserted into the connector 10, the jackwire contact 50 tends to move across the contact pad 46 as it flexes into its final position, creating a "wiping action" that may help remove debris from the jackwire contact 50 and/or contact pad 46 that may interfere with the electrical connection, and which may also generally result in an improved electrical connection between the jackwire contact 50 and the contact pad 46.

Figure 16:
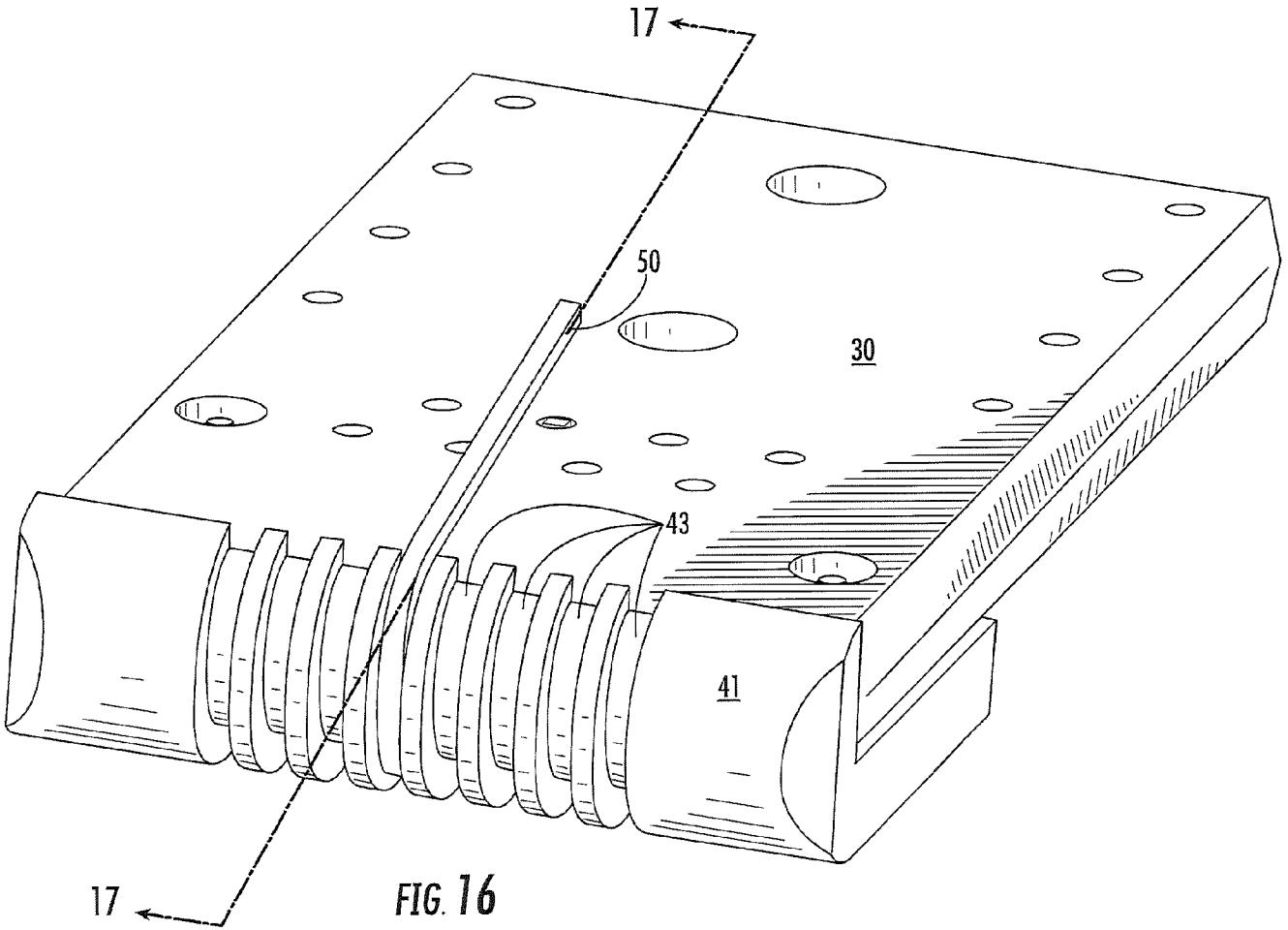
FIG. 16 is a perspective view of the assembly 20 of FIG. 3 in a partially assembled state.
Figure 17:
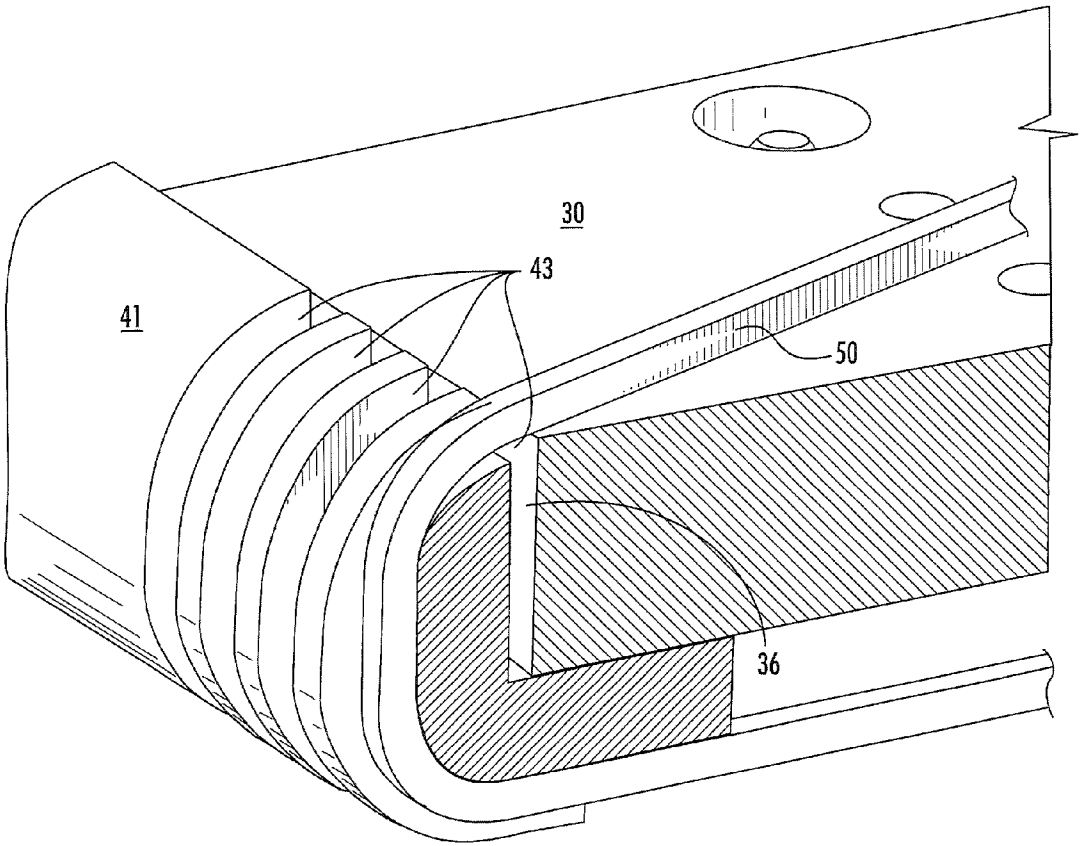
FIG. 17 is cross-sectional view taken along the line 17-17 in FIG. 16.

As noted above, a mandrel 41 may be provided that facilitates keeping the contacts 50 in proper alignment. FIGS. 16 and 17 show the assembly 20 of FIG. 3 in a partially assembled state in order to better illustrate the mandrel 41. As shown in FIGS. 16 and 17, the mandrel 41 includes a plurality of recesses 43 that define a comb structure that acts to properly align the jackwire contacts 50. Jackwire contacts 50 are positioned in respective ones of the recesses 43 once the assembly 20 is fully assembled (in FIGS. 16 and 17, only a single jackwire contact 50 has been mounted on the assembly 20). As shown best in FIG. 17, a cross-section taken through one of the recesses 43 may generally have a flattened "half-moon" profile adjacent the forward edge 36 of the printed circuit board 30.

Figure 18:
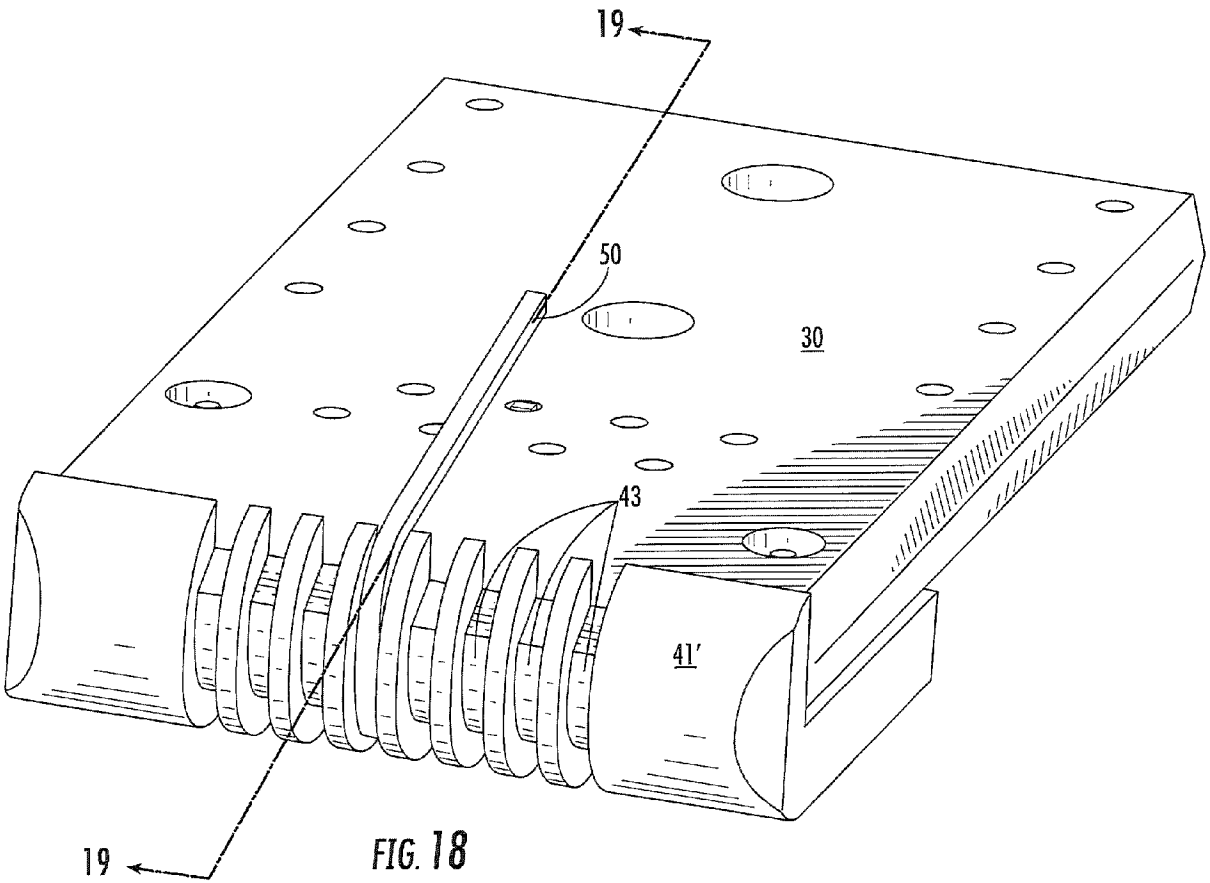
FIG. 18 is a perspective view of the assembly 20 of FIG. 3 in a partially assembled state using an alternative mandrel.
Figure 19:
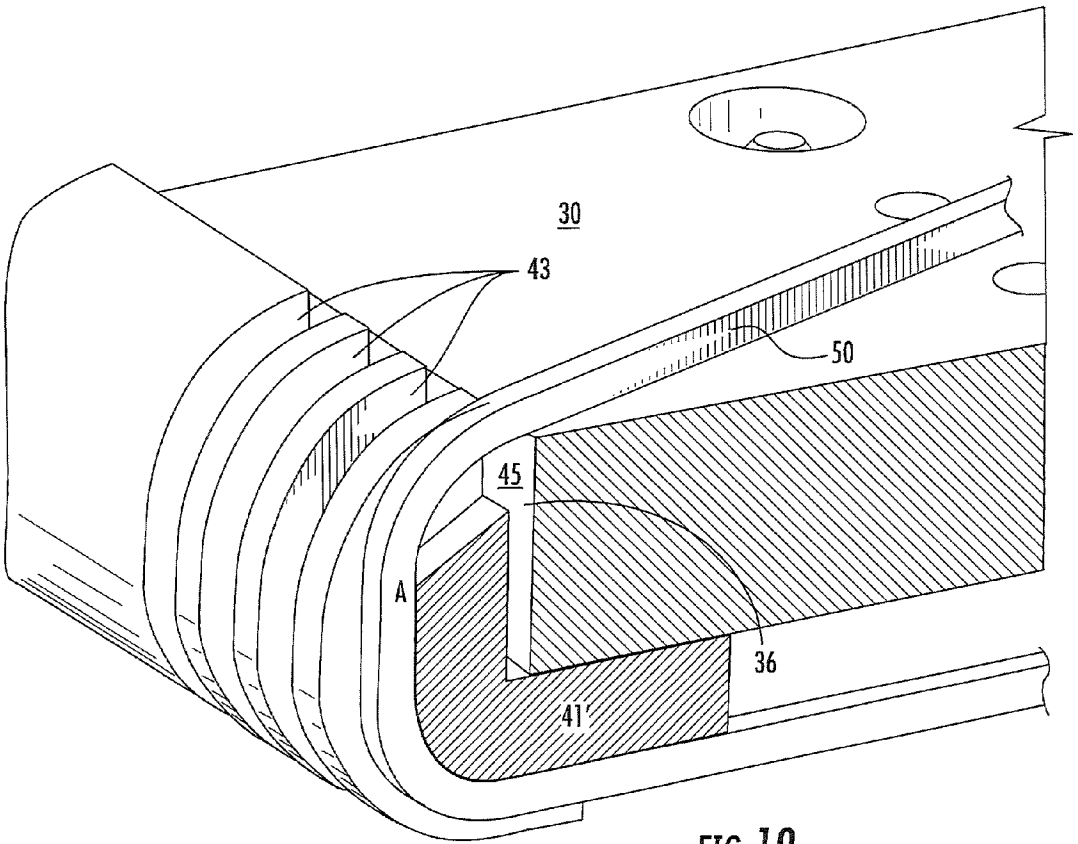
FIG. 19 is cross-sectional view taken along the line 19-19 in FIG. 18.

As shown in FIGS. 18 and 19, in other embodiments of the present invention, a mandrel 41' may be used. In mandrel 41', the top portion of the mandrel is removed in each of the recesses 43 such that a cross-section of the mandrel 41' taken through the recess has, for example, a flattened "quarter-moon" profile adjacent the forward edge 36 of the printed circuit board 30. By removing the upper portion of the mandrel 41' in each of the recesses 43, an open area 45 is provided in each recess 43 adjacent the top portion of the forward edge 36 of the printed circuit board 30. Because of this open area 45, the jackwire contacts 50 will tend to deflect about a moment arm located at the designation "A" in FIG. 19. The net result is that there may be increased wiping action between the jackwire contacts 50 and the contact pads 46, which may act to clean the jackwire contacts 50 and the contact pad 46 and thereby provide an improved connection with a lower contact resistance.

As can also be seen from FIGS. 4-5, when a plug is inserted into the communications connector 10, the bend between the lower segment 53 and the vertical segment 54 of each jackwire will tend to act as a fulcrum, such that at least the vertical segment 54, the pad contact region 56, the plug contact region 58 and the free end 59 will move when the plug is inserted. Thus, together each of the above regions of each jackwire contact 50 comprises part of a mobile region of the jackwire contact 50. By allowing the jackwire contacts 50 to flex along a substantial length below the plug contact region 58 it is possible to shorten the free ends 59 of the jackwire contacts 50, which may facilitate reducing the amount of crosstalk generated in the free ends of the jackwire contacts 59.

While the "free-floating" configuration of the jackwire contacts 50 may be desirable in some applications, when the contacts 50 spring away from the contact pads 46 as a modular plug is removed from the communications connector 10, a generally undesirable current arcing phenomena may occur between the jackwire contacts 50 and the contact pads 46. Accordingly, according to further embodiments of the present invention, the jackwire contacts 50 may be arranged so that they make electrical contact with their respective contact pads 46 regardless of whether or not a modular plug is mated with the communications connector 10.

As shown best in FIG. 7, a plurality of conductive paths 48 are provided on the printed circuit board 30 that extend between the input terminals 40 of the printed circuit board 30 and the output terminals 42 of the printed circuit board 30. As noted above, in FIG. 7, the conductive traces have all been shown as existing on the top surface of printed circuit board 30 for ease of description. However, it will be appreciated that all or parts of one or more of the traces would be implemented on additional layers of the printed circuit board 30 to facilitate crossing conductive paths 48 without creating a short-circuit between paths and/or to implement compensation stages (not shown in FIG. 7) on the printed circuit board 30.

In the embodiment of FIGS. 3-7, the contact pads 46 comprise the input terminals 40 through which communications signals are coupled onto the printed circuit board, and the metal-plated holes 44 that receive the IDCs 70 comprise the output terminals 42. Herein, "input terminals" and "output terminals" refer to, respectively, the structure through which electrical signals are transferred into or out of something (e.g., a printed circuit board, a communications connector, etc.). It will be understood that whether or not a particular structure comprises an "input" terminal or an "output" terminal will depend upon the direction of travel of the electrical signal. To simplify the description, a like set of terminals (e.g., the jackwire contacts or the IDCs) are referred to collectively as either a set of "input" terminals or a set of "output" terminals, even though in operation some of the electrical signals may travel in different directions.

As noted above, in the communications connector 10, each of the conductive paths 48 connects one of the contact pads 46 to a respective one of the insulation displacement connectors 70. The conductive paths 48 may be dimensioned and arranged on one or more layers of the printed circuit board 30 in such a manner that crosstalk is substantially reduced over an entire connection comprising the electrical connector 10 and an associated plug. U.S. Pat. No. 5,997,358, incorporated by reference herein, depicts a connector having a printed circuit board with eight layers that implements a multi-stage compensation scheme for substantially eliminating crosstalk that is present at the input terminals of the printed circuit board. Such crosstalk compensation schemes may be implemented in numerous different forms, and may rely on, for example, inductive and or capacitive coupling between the conductive paths 48 and/or discrete components such as resistors, capacitors and inductors for crosstalk reduction between pairs of conductive paths. Embodiments of the present invention are not limited to any particular type or strategy for reducing and/or eliminating crosstalk on the printed circuit boards of the connectors disclosed herein, and it will also be appreciated that at least some of the crosstalk compensation may be achieved in other locations such as in the jackwire contacts (which are also referred to sometimes herein as "the leadframe"), in the plug, in a second printed circuit board, etc.

In the embodiment of FIGS. 3-7, each of the conductive traces 48 comprises part of a signal carrying path that extends from one of the input terminals 40 to a respective one of the output terminals 42 of the communications connector 10. This signal carrying path, thus, carries a signal that is input from a plug contact onto one of the jackwire contacts 50 of the connector 10 to a corresponding IDC 70. Herein, the term "signal carrying path" refers to a direct path that may be used to carry a signal coupled onto an input terminal of the connector to an output terminal of the connector. It will be appreciated that, in many cases, branch segments will extend from one or more of the signal carrying paths within a communications connector. These branch segments may be electrically connected to the signal carrying path, but are not part of the signal carrying path, as the branch segments "dead-end" and hence the input signal generally does not traverse the branch when traveling from the input terminal to the output terminal of the connector. By way of example, in the communications connector 10 of FIGS. 3-7, eight signal carrying paths are provided, each of which extends from the plug contact region 58 of one of the jackwire contacts 50, along the jackwire contact 50 to the pad contact region 56, through the corresponding contact pad 46, along the conductive trace 48 that is coupled to the contact pad 46, through one of the metal-plated IDC holes 44 to which the other end of the conductive trace 48 connects, and finally through one of the IDCs 70. Various branch segments extend from each of these signal carrying paths, such as, for example, the free end 59 of each contact and the vertical and lower segments 53, 54 of each contact. These branches are electrically connected to the signal carrying path, but are not part of the signal carrying path, as they "dead-end" instead of providing a conductive path from the input of the connector to the output of the connector. Various other branches that are not part of the signal carrying path may also be provided such as, for example, interdigitated and/or plate capacitors that may be connected to the metal-plated hole 44 that receives the termination end 52 of the jackwire contact and/or which branch directly off of the contact pads 46, the conductive paths 48 and/or the metal-plated holes 44 that receive the IDCs 70. It will also be appreciated that more than one signal carrying path may exist between a specific input terminal and its respective output terminal. In such cases, both paths together constitute the signal carrying path.

The jackwire contacts 50 of communications connector 10 run parallel to each other along substantially their entire length. These jackwire contacts 50 may be simpler and less expensive to manufacture than the jackwires contacts included in many conventional communications connectors that include, for example, crossing contacts. Moreover, the contact pads 46 may be located at a relatively short electrical distance from the plug contact area 58 of the contacts, thereby providing a leadframe structure that has a relatively short delay. As a result, the additional crosstalk generated in the leadframe may be relatively small, and may be relatively easy to compensate for on, for example, the printed circuit board 30.

FIG. 8 is a perspective view of an assembly 120 for a connector according to embodiments of the present invention. The assembly 120 could be used in conjunction with, for example, the same housing structures included with the connector 10 of FIGS. 3-7.

As shown in FIG. 8, the assembly 120 includes a printed circuit board 130, a plurality of jackwire contacts 150 having mounted ends that are mounted in the bottom surface 134 of the printed circuit board 130, and a plurality of IDC terminals 170. The printed circuit board 130 includes a plurality of conductive paths 148 (not shown in FIG. 8), and a plurality of contact pads 146 are mounted on the top surface 132 of the printed circuit board 130 at or adjacent the forward edge 136 of the circuit board 130.

In the embodiment of FIG. 8, the contact pads 146 are only provided on the top surface 132 of the printed circuit board 130. In particular, the contact pads 146 do not extend around the forward edge 136 of the printed circuit board 130 as do the contact pads 46 depicted in the embodiment of FIGS. 3-7. By forming the contact pads 146 on only a single surface of the printed circuit board 130, it may be possible to simplify the manufacture of the printed circuit board, which may result in cost savings.

In order to provide a more robust and reliable mechanical and electrical connection between the jackwire contacts 150 and their respective contact pads 146 in the embodiment of FIG. 8, the jackwire contacts 150 may include one or more undulations 151 such as the U-shaped bend shown in each of the jackwire contacts 150. Herein, references to an "undulation" in a contact refer to a portion of the contact that dips closer to a printed circuit board to make electrical contact a contact pad when a plug is inserted into the connector. The undulation may, for example be U-shaped or V-Shaped, and it may be shallow or deep. The undulation also need not be symmetric.

As shown in FIG. 8, the undulation 151 in each jackwire contact 150 is positioned directly over the corresponding contact pad 146. When a modular plug is brought into contact with the jackwire contacts 150 (i.e., when the modular plug is inserted into a communications connector that includes the assembly 120), the jackwire contacts 150 are forced downward to mate with their respective contact pads 146, and the undulation 151 in each contact makes mechanical and electrical connection with its corresponding contact pad 146. Typically, a wiping action will result where the undulation region 151 of the jackwire contact 150 wipes across the contact pad 146 to provide a robust electrical connection.

Note that in the embodiment of FIG. 8, the pad contact region 156 of each jackwire contact 150 may be moved closer to the plug contact area 158 of each contact. As a result, the electrical distance between the plug contact area 158 and the contact pads 146 may be reduced.

Figure 9:
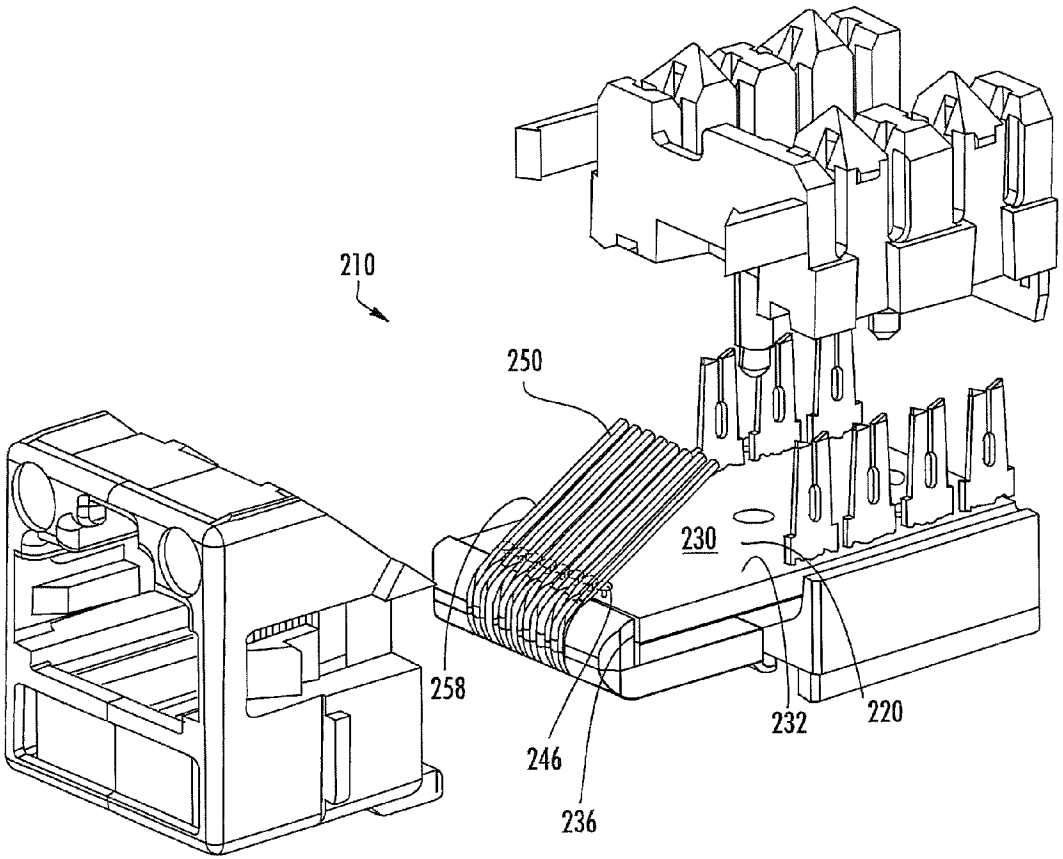
FIG. 9 is an exploded perspective view of a communications connector according to additional embodiments of the present invention.

FIG. 9 is a perspective view of a connector 210 that includes an assembly 220 according to further embodiments of the present invention. To simplify the description, the connector 210 is illustrated as including the same housing structures as the connector 10 of FIGS. 3-7. Consequently, the housing structures are not numbered in FIG. 9, and the description below is limited to the assembly 220 which contains certain differences from the assembly 20 of the connector 10 described above.

As shown in FIG. 9, the assembly 220 includes a plurality of raised contact pads 246. The contact pads 246 are referred to as "raised" contact pads because they extend above the upper surface of the printed circuit board 230 (it will be understood that herein the "upper surface" of the printed circuit board is defined by the higher of the upper portion of the dielectric board and the upper portion of any conductive traces that are provided on the dielectric board). By using raised contact pads 246, the electrical distance between the plug contact region 258 of each jackwire contact 250 and its corresponding contact pad 246 can be reduced as compared to, for example, the corresponding distance between the plug contact region 58 of each jackwire contact 50 and its corresponding contact pad 46 in the communications connector 10 of FIGS. 3-7. As noted above, by reducing this electrical distance, it may be possible to reduce the additional crosstalk introduced in the leadframe, which may improve the overall crosstalk performance of the connector.

In embodiments of the present invention, the raised contact pads 246 may be implemented, for example, as small nails that are inserted into plated-metal holes 244 in the printed circuit board 230. Such nails may be purchased commercially. For example, Mill-Max (www.mill-max.com) offers a "printed circuit pin" product which comprises a small nail that may be used in certain embodiments of the present invention. It will be appreciated that herein, the term "nail" is intended to refer to any object that includes a base portion that may be inserted into a substrate (or into a hole in a substrate) and a head portion that is connected to the base portion and that extends above the substrate when the nail is in place, and thus the term "nail" is not limited to just traditional "nails." The nails may comprise, for example, brass nails that are plated with gold or another highly conductive metal. Alternatively, the nails may be made from pure gold, although the use of such nails may increase the overall cost of the connector. The gold or other plating may be thicker on the raised or "head portion" of the nail that makes physical contact with a corresponding jackwire contact 250. By providing thicker plating on the head portion of the nail the possibility of the plating wearing away with use may be reduced, while minimizing the total amount of gold used to form the raised contact pad 246.

In further embodiments of the present invention, the raised contact pads may comprise small spring contact pads that are mounted in the printed circuit board. By way of example, small printed circuit board spring contact pads are available commercially from Cinch (the Cinch "iQ" contacts). The use of such spring contact pads may provide for more robust and reliable electrical connections between the jackwire contacts and the contact pads.

Figure 10:
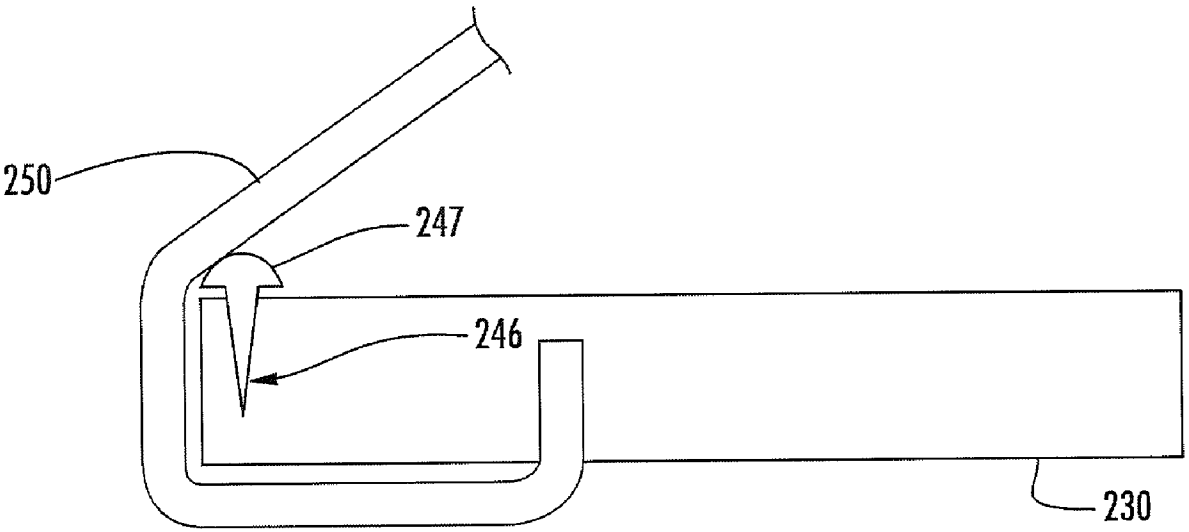
FIG. 10 is a cross-sectional view of a printed circuit board with a nail that may be used as a raised contact pad according to embodiments of the present invention.

In certain embodiments of the present invention, the top surface 247 of the nail or other raised contact pad 246 may have a dome-shaped surface as shown, for example, in FIG. 10. The use of such a domed surface may increase the surface area over which the jackwire contact 250 and the raised contact pad 246 physically contact during operation of the connector. Herein, the term "dome-shaped surface" is intended to include hemispherical shapes, partial ovoid shapes and any other generally or partially rounded three dimensional shapes that are designed to increase the surface area over which the jackwire contact 250 and the raised contact pad 246 physically contact during operation. It will also be appreciated that the top surface may have other shapes such as a sloped or pyramidal shape that can be used to increase the surface area over which contact is made.

The raised contact pads 246 pictured in FIGS. 9-10 above may be more physically robust than the contact pads 46 or 146 in the embodiments of FIGS. 3-7 and FIG. 8, respectively, as the raised contact pad 246 may include a thicker metal top surface 247 that is less prone to wearing away. For example, in certain embodiments, the head portions of the raised contact pads 246 may be 10-30 mils thick or more. The use of raised contact pads 246 also facilitates positioning the contact pads away from the forward edge of the circuit board 230 without necessarily requiring an additional bend in the jackwire contacts such as the undulation 151 provided in the jackwire contacts 150 of FIG. 8.

Figure 11:
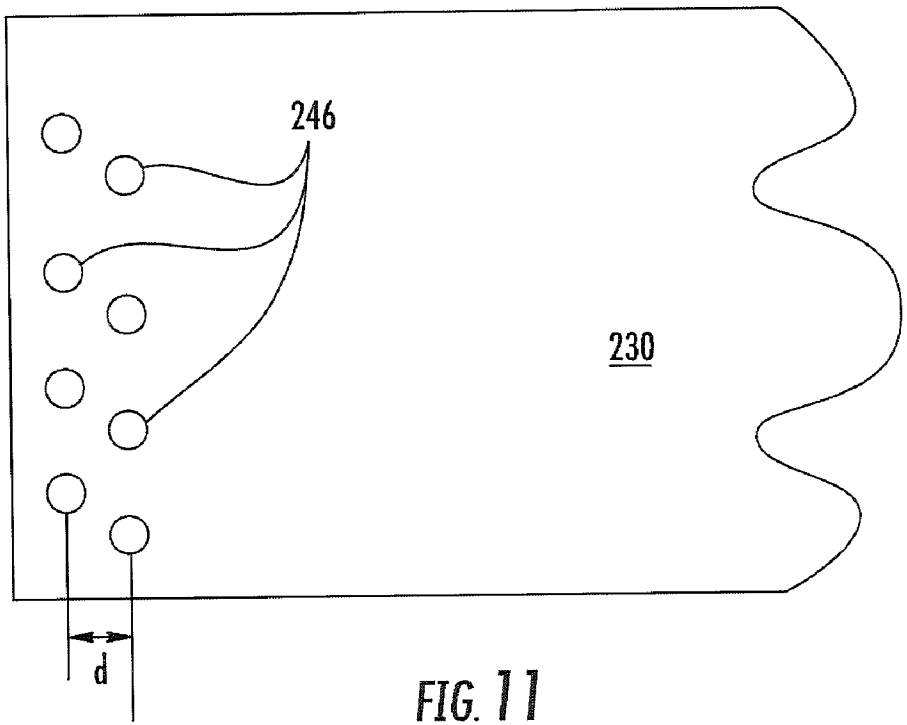
FIG. 11 is a plan view of a portion of the printed circuit of the communications connector of FIG. 9 illustrating an arrangement in which the raised contact pads are arranged in multiple rows.

As shown in FIG. 11, the raised contact pads 246 may be arranged in two or more rows. The use of multiple rows of raised contact pads may help reduce the possibility of arcing or short circuits between adjacent raised contact pads 246, and may also provide increased room for running conductive traces to each of the raised contact pads 246 in or on the printed circuit board 230. In certain embodiments of the present invention, the distance "d" shown in FIG. 11 between the first and second rows of raised contact pads may be between, for example, about 40-60 mils. When such a multi-row configuration of raised contact pads is employed, the contact pads in the second row may be taller than the contact pads in the first row. By having raised contact pads 246 with such different heights, it may be possible to have the jackwire contacts 250 exert approximately the same amount of force on each raised contact pad 246 regardless of whether or not the raised contact pad is in the first or second row. It will also be appreciated that the contact pattern depicted in FIG. 11 is exemplary, and that numerous other patterns could be employed.

Figure 12:
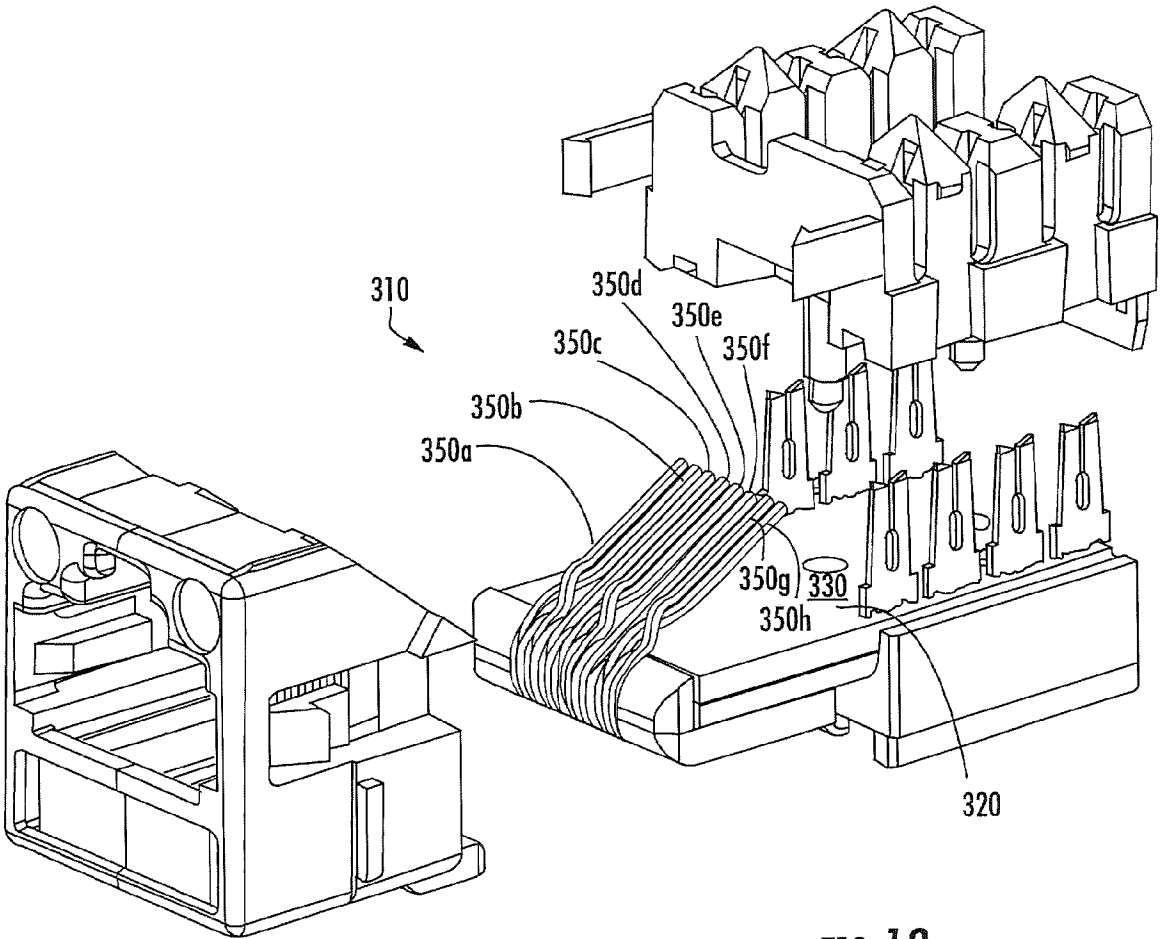
FIG. 12 is an exploded perspective view of a communications connector according to still further embodiments of the present invention.

Pursuant to further embodiments of the present invention, communications connectors are provided that include jackwire contacts that have crossovers or other configurations that are designed to introduce crosstalk compensation within the lead frame. FIG. 12 is an exploded perspective view of a communications connector 310 that includes jackwire contacts 350*a*-350*h* which cross over one another in order to introduce compensating crosstalk in the leadframe of the connector. In particular, jackwire contacts 350*a* and 350*b* cross over each other to trade positions within the lead frame, as do jackwire contacts 350*d* and 350*e* and 350*g* and 350*h*. As the communications connector 310 is identical to the communications connector 10 except for the crossovers in the leadframe, further discussion of the connector 310 will be omitted.

In another embodiment not pictured herein, jackwire contacts 350*c* and 350*f* cross over each other to trade positions in the leadframe in place of the crossovers of jackwire contacts 350*a*/350*b*, 350*d*/350*e* and 350*g*/350*h* depicted in FIG. 12. Moreover, in the embodiment of FIG. 12, the crossovers are located adjacent the forward edge of the printed circuit board 330. It will also be appreciated that, according to further embodiments of the present invention, the crossovers may be located in a variety of different locations such as, for example, adjacent the free ends of the jackwire contacts, between the plug contact region and the pad contact region of the contacts and/or in the lower segment.

Figure 13:
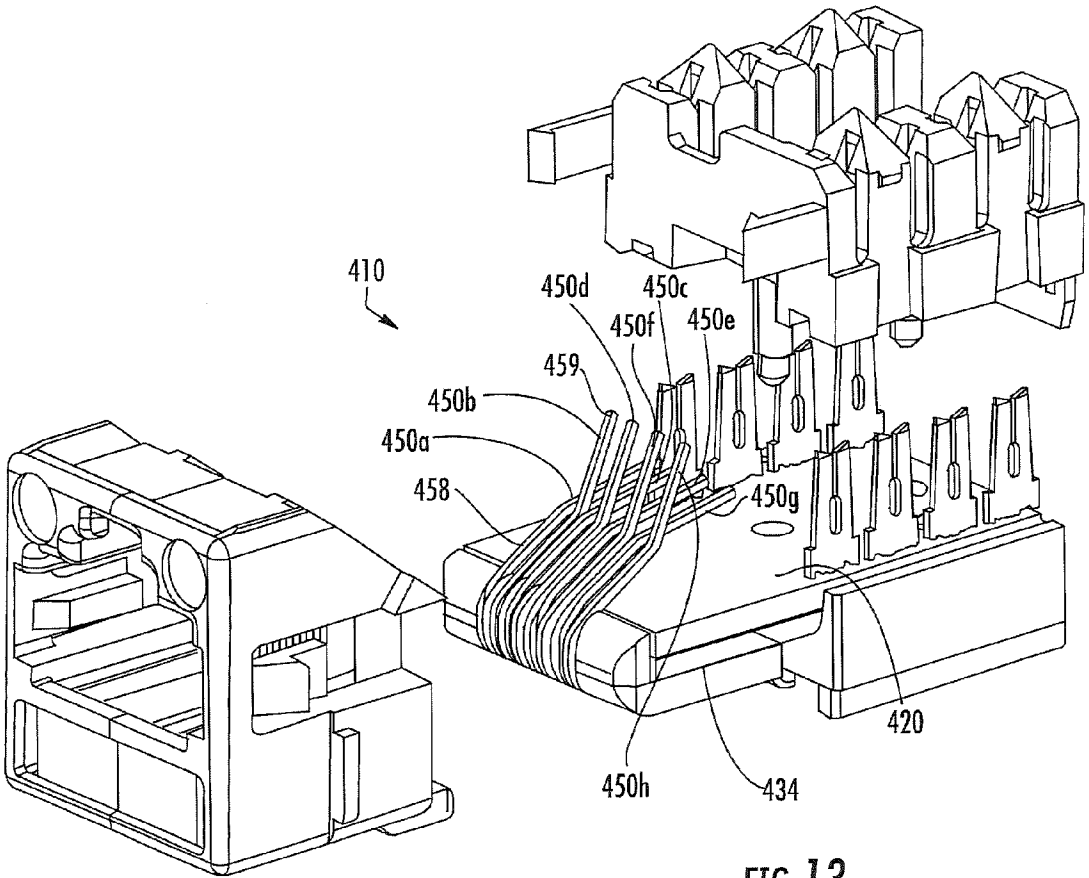
FIG. 13 is an exploded perspective view of a communications connector according to additional embodiments of the present invention.

Pursuant to further embodiments of the present invention, the jackwire contacts may be configured to introduce compensating crosstalk in the leadframe without the use of crossovers. By way of example, as shown in FIG. 13, a communications connector 410 may be provided that is almost identical to the communications connector 10 of FIGS. 3-7, except that the free ends 459 of the jackwire contacts 450 of communications connector 410 are "staggered" beyond (and possibly in) the plug contact region 458 so that the distance between at least some of the adjacent jackwire contacts 450 is increased. For example, as shown in FIG. 13, the free ends 459 of the jackwire contacts 450*c* and 450*e* are bent downwardly, while the free ends 459 of the jackwire contacts 450*d* and 450*f* are bent upwardly. In this manner, the amount of offending crosstalk generated, for example, between contacts 450*c* and 450*d* and between contacts 450*e* and 450*f* may be reduced and, depending upon the relative configuration of the free ends 459 of contacts 450*c*-450*f*, compensating crosstalk may even be introduced. The stagger may be included in the free ends of additional and/or different contacts, and numerous different staggering techniques may be used.

Figure 14:
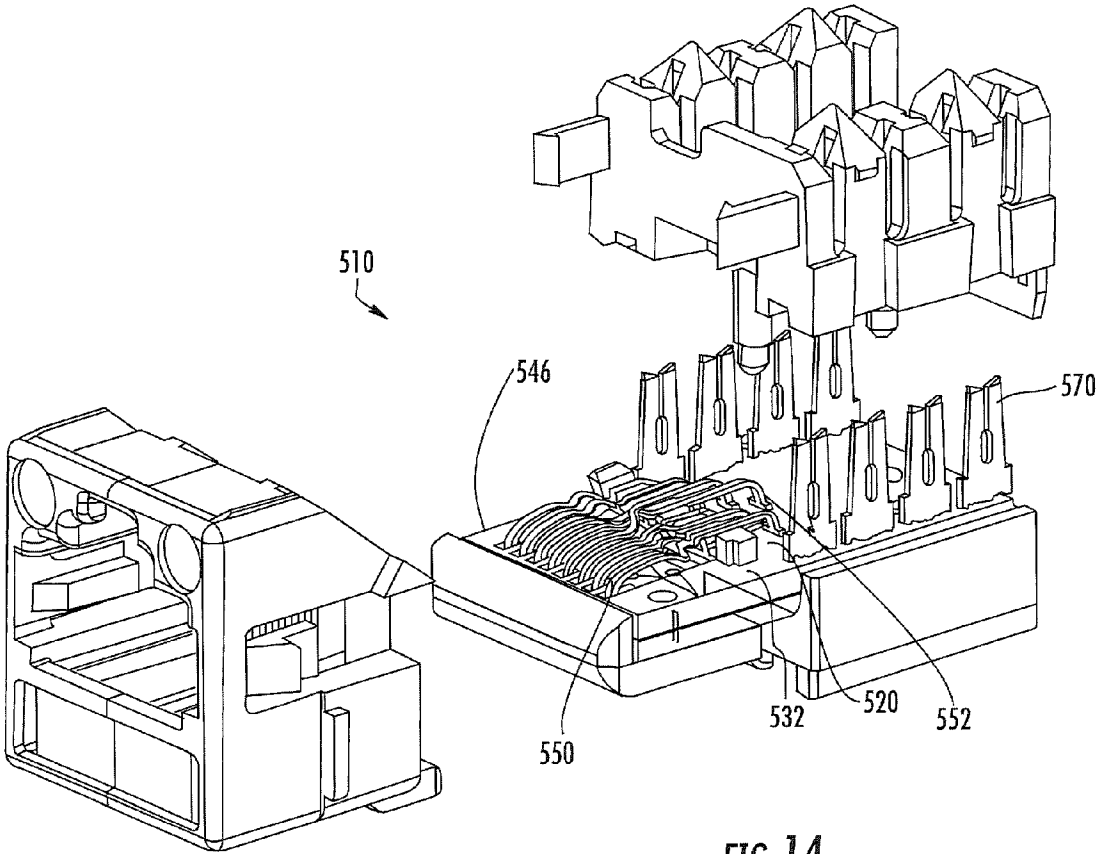
FIG. 14 is a schematic diagram of a communications connector according to still additional embodiments of the present invention.

FIG. 14 is an exploded perspective view of a communications connector 510 according to yet another embodiment of the present invention. The communications connector 510 is similar to the communications connector 10 discussed above. However, in the communications connector 510, the mounted ends 552 of the jackwire contacts 550 are mounted into the top surface 532 of the printed circuit board 530, and thus the jackwire contacts 550 do not wrap around the printed circuit board 530 as do the jackwire contacts 50 in the communications connector 10. A plurality of contact pads 546 are provided adjacent the forward edge 536 of the top surface 532 of the printed circuit board 530. The free end of each contact is configured to mate with a respective one of the contact pads 546 when a modular plug is inserted into the connector 510. A plurality of traces are provided on one or more layers of the printed circuit board 530 that connect each of the contact pads 546 to a respective one of the IDCs 570. Crosstalk compensation circuits may be provided on the printed circuit board 530 that are connected to the contact terminations 552 of one or more of the jackwire contacts 550. U.S. Pat. No. 6,350,158, which is incorporated by reference herein as if set forth in its entirety, provides further details regarding particular configurations for jackwire contacts and contact pads that may be employed in the embodiment of FIG. 14.

The connector 510 depicted in FIG. 14 also has a leadframe that includes three crossovers at which one jackwire contact 550 of a pair is stepped toward and crosses over the other jackwire contact of the pair, with a generally "S"-shaped side-wise step. Each crossover may be implemented by having the jackwire contacts of a wire pair curve arcuately above and below their common plane at each cross-over location. Opposing faces of the jackwire contacts may, for example, be spaced by about 0.040 inches (i.e., enough to prevent shorting when the jackwire contacts 550 are engaged by a modular plug).

Figure 15:
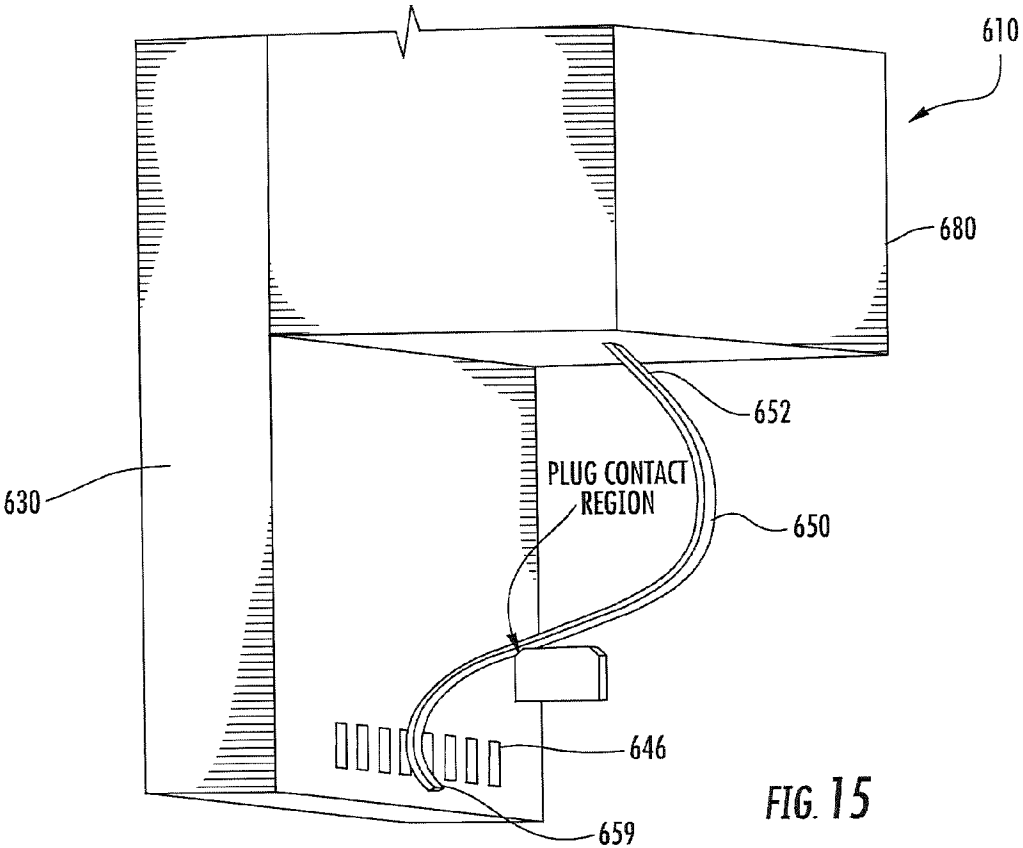
FIGS. 15 and 15A are schematic diagrams of a communications connector according to other embodiments of the present invention.
Figure 15A:
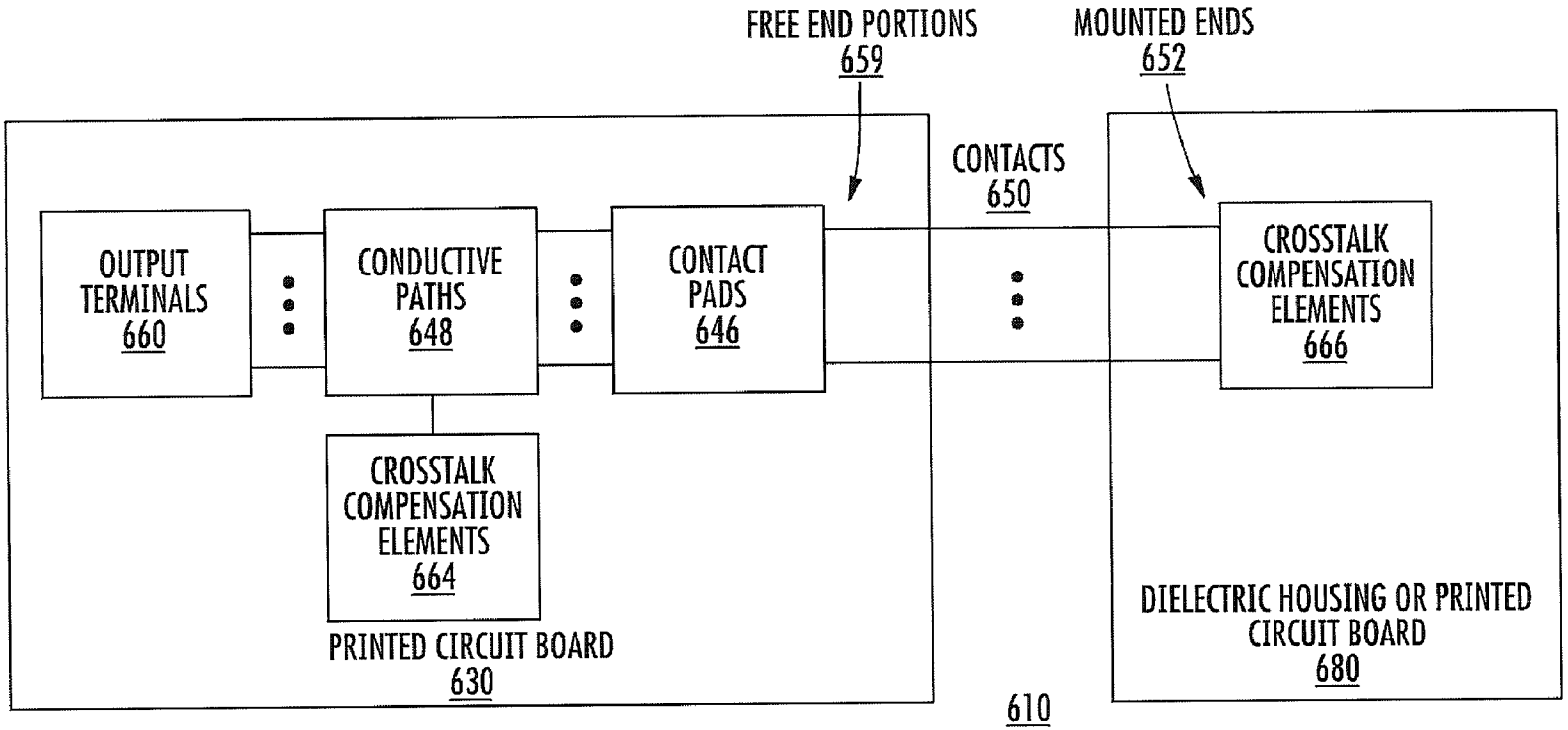

FIGS. 15 and 15A are schematic diagrams of portions of a communications connector 610 according to still further embodiments of the present invention. As shown in FIGS. 15 and 15A, the connector 610 includes a printed circuit board 630 and a plurality of jackwire contacts 650 (only one jackwire contact is pictured in FIG. 15). The mounted ends 652 of the jackwire contacts 650 are mounted in a first substrate 680. This first substrate 680 may comprise, for example, part of a dielectric jack housing or some other portion of the body of the connector 610. The substrate 680 could also comprise a second printed circuit board. The printed circuit board 630 includes a plurality of contact pads 646 that are configured to mate with free end portions 659 of respective of the jackwire contacts 650.

When a modular plug (an exemplary blade is depicted in FIG. 15) is inserted into the connector 610, the free ends 659 of the jackwire contacts 650 are in electrical and mechanical contact with respective of the contact pads 646. A plurality of conductive traces 648 (shown in FIG. 15A) are provided on the printed circuit board 630 that connect each of the contact pads 646 to respective output terminals 660 of the connector (depicted in FIG. 15A). The printed circuit board 630 may further include crosstalk compensation elements 664 (shown in FIG. 15A) that may be electrically connected to, for example, the conductive traces 648. Crosstalk compensation circuits 666 may also be mounted in the substrate 680 and connected to one or more of the mounted ends 652 of the jackwire contacts 650.

In the embodiment of FIGS. 15 and 15A, the mounted ends 652 of the jackwire contacts 650 are mounted in a first substrate (substrate 680), while the plurality of conductive traces 648 that carry the respective signals to the output terminals 660 of the connector are mounted in or on a second substrate (namely printed circuit board 630). Such an embodiment may be particularly well suited for patch panel applications, where typically the printed circuit board is mounted at an angle normal to the axis on which a plug enters the connector. Patch panels are known to those of skill in the art and include, for example, panels that include one or more rows of connector modules, where each connector module includes a plurality of modular jacks and/or rows of modular jacks.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications connector, comprising:

a plurality of contacts, each contact having a termination end that is mounted in a first substrate and a free end portion; and a second substrate that is distinct from the first substrate, wherein the second substrate comprises a first printed circuit board that includes a plurality of contact pads that mate with the free end portions of respective ones of the plurality of contacts, a plurality of output terminals, and a plurality of conductive paths that connect at least some of the plurality of contact pads to respective ones of the plurality of output terminals.

2. The communications connector of claim 1, wherein a first of the plurality of contacts includes a plug contact region, and wherein the portion of the first of the plurality of contacts that mates with its respective one of the plurality of contact pads is between the plug contact region of the contact and a free end of the contact.

3. The communications connector of claim 1, wherein the first substrate comprises a dielectric housing of the communications connector.

4. The communications connector of claim 1, wherein the first substrate comprises a second printed circuit board.

5. The communications connector of claim 1, wherein a first plane defined by the first substrate and a second plane defined by the second substrate are not parallel planes.

6. The communications connector of claim 5, wherein the first plane is substantially normal to the second plane.

7. The communications connector of claim 1, wherein the first printed circuit board further includes at least one crosstalk compensation element.

8. The communications connector of claim 7, wherein the second printed circuit board further includes at least one crosstalk compensation element.

9. The communications connector of claim 1, wherein the first substrate directly contacts the second substrate.

10. A communications connector, comprising:

a jackwire contact having a termination end that is mounted in a first substrate and a free end portion; and a second substrate that is distinct from the first substrate, wherein the second substrate comprises a first printed circuit board that includes a contact pad that mates with the free end portion of the jackwire contact, an output terminal, and a conductive path that connects the contact pad to the output terminal.

11. The communications connector of claim 10, wherein the first substrate comprises a second printed circuit board.

12. The communications connector of claim 10, wherein the first substrate comprises a housing of the communications connector.

* * * * *